US006626813B1

(12) United States Patent
Ratzel et al.

(10) Patent No.: US 6,626,813 B1
(45) Date of Patent: Sep. 30, 2003

(54) CUSHIONING CONVERSION SYSTEM AND METHOD FOR MAKING A COIL OF CUSHIONING PRODUCT

(75) Inventors: Richard O. Ratzel, Westlake, OH (US); James A. Simmons, Jr., Painesville Township, OH (US); Joseph J. Harding, Mentor, OH (US); Edward W. Lintala, Concord, OH (US); Thomas E. Manley, Mentor, OH (US)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 09/551,094

(22) Filed: Apr. 18, 2000

Related U.S. Application Data

(63) Continuation of application No. PCT/US98/22726, filed on Oct. 27, 1998.

(60) Provisional application No. 60/063,275, filed on Oct. 27, 1997, provisional application No. 60/071,164, filed on Jan. 12, 1998, and provisional application No. 60/095,702, filed on Aug. 7, 1998.

(51) Int. Cl.[7] ..... B31D 5/00

(52) U.S. Cl. ..... 493/464; 493/967

(58) Field of Search ..... 493/464, 967

(56) References Cited

U.S. PATENT DOCUMENTS

| | | | | | |
|---|---|---|---|---|---|
| 3,598,328 | A | * | 8/1971 | Richards et al. | 139/224 A |
| 3,946,956 | A | * | 3/1976 | Marzoli | 242/480.4 |
| 4,042,384 | A | * | 8/1977 | Jackson et al. | 226/196.1 |
| 4,161,298 | A | | 7/1979 | Davis | |
| 4,237,776 | A | | 12/1980 | Ottaviano | |
| 4,905,491 | A | * | 3/1990 | Starke et al. | 700/156 |
| 4,928,904 | A | * | 5/1990 | Watts | 242/478.2 |
| 4,951,895 | A | * | 8/1990 | Hirai | 156/406.4 |
| 5,142,891 | A | * | 9/1992 | Kuwano | 72/11.4 |
| 5,462,241 | A | | 10/1995 | Howden, Jr. | |
| 5,533,689 | A | | 7/1996 | Chalfant | |
| 5,713,533 | A | * | 2/1998 | Nordlof et al. | 226/42 |
| 5,941,674 | A | * | 8/1999 | Briehl | 156/584 |
| 6,203,481 | B1 | * | 3/2001 | Harding et al. | 493/10 |
| 6,217,501 | B1 | * | 4/2001 | Simmons et al. | 493/12 |
| 6,263,714 | B1 | * | 7/2001 | Johnson et al. | 72/10.3 |
| 6,408,222 | B1 | * | 6/2002 | Kim et al. | 164/452 |

FOREIGN PATENT DOCUMENTS

| | | |
|---|---|---|
| BE | 1003899 A6 | 7/1992 |
| EP | 0 143 452 A | 6/1985 |
| WO | 96/03274 | 2/1996 |

* cited by examiner

*Primary Examiner*—Rinaldi I. Rada
*Assistant Examiner*—Gloria R Weeks
(74) *Attorney, Agent, or Firm*—Renner, Otto, Boisselle & Sklar, LLP

(57) ABSTRACT

A cushioning conversion system (20; 120; 320) and method for making a coil of cushioning product, including a cushioning conversion machine (22; 122; 322) and a coiler (24; 124; 224; 324). As a strip of cushioning product (S) is emitted from the cushioning conversion machine (22; 122; 322), the coiler (24; 124; 224; 324) rolls the strip of cushioning product (S) into a coiled configuration to form a coil of cushioning product (C). The coiler (24; 124; 224; 324) is adapted to allow the coil of cushioning product (C) to be removed in its coiled configuration. The cushioning conversion system may also include a guide device (26; 326), which guides the strip of cushioning product from the cushioning conversion machine's outlet (34) to the coiler (24; 124; 324), and/or a controller (28; 328), which controls the coiler (24; 124; 224; 324) based on the production of the cushioning conversion machine (22; 122; 322).

85 Claims, 10 Drawing Sheets

CUSHIONING CONVERSION SYSTEM AND METHOD FOR MAKING A COIL OF CUSHIONING PRODUCT

This application is a continuation of International Application No. PCT/US98/22726 filed Oct. 27, 1998, which claims priority of provisional application Nos. 60/063,275 filed Oct. 27, 1997, 60/071,164 filed Jan. 12, 1998 and 60/095,702 filed Aug. 7, 1998.

This invention relates generally as indicated to a cushioning conversion system and method for making a coil of cushioning product.

BACKGROUND OF INVENTION

In the process of shipping an item from one location to another, a protective packaging material is typically placed in the shipping container to fill any voids and/or to cushion the item during the shipping process. Also, with particular reference to a relatively large and/or heavy item (such as, for example, large pieces of industrial equipment), protective packaging material may be used to block or brace the item during shipping. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alterative. Paper is biodegradable, recyclable and renewable; making it an environmentally responsible choice for conscientious companies.

While paper in sheet form could possibly be used as a protective packaging material, it is usually preferable to convert the sheets of paper into a low density cushioning product. This conversion may be accomplished by a cushioning conversion machine, such as those disclosed in U.S. Pat. Nos. 4,026,198; 4,085,662; 4,109,040; 4,237,776; 4,557,716; 4,650,456; 4,717,613; 4,750,896; 4,968,291; 5,061,543; 5,123,889; 5,188,581; 5,211,620; 5,322,477; 5,387,173; 5,468,208; 5,542,232; 5,571,067; 5,593,376; and 5,607,383. (These patents are all assigned to the assignee of the present invention and their entire disclosures are hereby incorporated by reference.)

A cushioning conversion machine, such as those disclosed in the above-identified patents, includes a conversion assembly which converts sheet-like stock material, preferably paper in multi-ply form, into a low density strip of cushioning product. In the above-identified patents, the conversion assembly includes a forming assembly and a feed assembly. During operation of the machine, a stock supply assembly supplies the stock material to the forming assembly. The forming assembly causes inward turning of the lateral edges of the sheet-like stock material to form a strip having lateral pillow-like portions and a central band therebetween. The feed assembly advances the stock material through the forming assembly, preferably by pulling the stock material through the forming assembly with a set of rotating gear-like members which also coin the central band of the continuous strip to form a strip of cushioning.

When using the packaging material produced by a cushioning conversion machine as void fill and/or cushioning, the strip of cushioning is usually cut into sections of a desired length, usually within a range between six inches and forty-eight inches. To this end, a cushioning conversion machine will usually include a cutting or severing assembly, positioned downstream of the conversion assembly, which cuts or severs the strip of cushioning into sections of desired lengths. In any event, the cut sections are then individually placed in the shipping container to fill any voids and/or to cushion the item during the shipping process.

When using the packaging material produced by a cushioning conversion machine to block or brace a relatively large and/or heavy item during shipping, the strip of cushioning may be "wound up" in a coil configuration to form a "coil" of cushioning product. The coil of cushioning product may then be placed in the shipping container and the large/heavy item placed thereon. Another coil of cushioning product may be placed on top of the item if necessary or desired. The blocking and bracing ability of such a coil of cushioning product is quite satisfactory, for example, it is easily capable of supporting the weight of an average man.

In the past, coils of cushioning product have been produced by using a cushioning conversion machine to convert sheet-like stock material into a strip of cushioning product of a specified length and then having packaging personnel manually roll or wind this strip of cushioning product into a coiled configuration, in a manner similar to rolling up a sleeping bag after a night of camping. Alternatively, packaging personnel have stood at the outlet of the cushioning conversion machine and rolled the strip of cushioning product into a coil as it is emitted from the machine. While perhaps effective, the characteristics of the coiled configuration (for example, tightness, axial alignment, etc.) are somewhat dependent upon the individual packager's efforts, skill, and other arbitrary factors, thus there is always the risk of inconsistency between coils. With particular reference to the first procedure, it can be time and/or space consuming, in that it requires the "straight" strip of cushioning product to be placed in a designated (hopefully neither dirty nor dusty) area prior to being rolled or coiled.

U.S. Pat. No. 4,237,776 discloses a transfer vehicle which receives a predetermined amount of dunnage pad (or, in other words, a strip of cushioning product of a specified length) from a cushioning conversion machine and winds the strip of cushioning product into a roll. This transfer vehicle is designed for subsequent transfer of the rolled strip of cushioning product to a packaging area distant from the cushioning conversion machine whereat the rolled strip of cushioning product is pulled from the transfer vehicle, cut into sections of desired length, and the cut sections are used for packaging purposes. The patent states that this arrangement enables "the dunnage pad product to be utilized in various areas of an establishment without the necessity of having a dunnage producing machine located at each area wherein use of dunnage is desired." Consequently, this prior art transfer vehicle is not designed to provide a coil of cushioning product which remains in a coiled configuration when used for packaging purposes.

Accordingly, a need remains for a cushioning conversion system or method which allows the convenient and consistent coiling of a strip of cushioning product into a coil of cushioning product which may be used for packaging purposes.

SUMMARY OF INVENTION

The present invention provides a cushioning conversion system and method for making a coil of cushioning product.

The system includes a cushioning conversion machine and a coiler. The cushioning conversion machine includes a conversion assembly which converts a sheet-like stock material into a strip of cushioning product and has an outlet through which the strip of cushioning product is emitted. The coiler rolls the strip of cushioning product into a coiled configuration to form a coil of cushioning product.

According to one preferred aspect of the invention, the coiler is shaped and positioned to receive the strip of cushioning product as it is emitted from the outlet and to allow the coil of cushioning product to be removed in its coiled configuration.

According to another preferred aspect of the invention, the cushioning conversion system includes a guide device which guides the strip of cushioning product from the cushioning conversion machine's outlet to the coiler. The guide device includes at least one portion, and preferably two portions, which move to accommodate the strip of cushioning product as the diameter of the coil of cushioning product increases. Specifically, the portions of the guide device are hinged so that they may be pivoted between a coil-begin position whereat they accommodate the strip of cushioning product at the beginning of the formation of the coil, and a coil-complete position whereat it accommodates the strip of cushioning product at the completion of the formation of the coil, and a plurality of positions therebetween. In the coil-begin position, the portions of the guide device extend from the cushioning conversion machine's outlet to the coiler's center of rotation; and in the coil-complete position, the portions extend from the cushioning conversion machine's outlet to a circumferential portion of the completed coil of cushioning product. In this manner, the guide device resembles a "duck bill" as it opens to accommodate the increasing diameter of the coil of cushioning product. The portions of the guide device may additionally be movable to coil-release position whereat the portions extend from the cushioning conversion machine's outlet to a point even beyond the circumferential portion of the coil of cushioning product.

According to another preferred aspect of the invention, the cushioning conversion system includes a controller which controls the coiler based on the cushioning conversion machine. The controller includes a strip-production indicator which indicates whether a strip of cushioning product is being produced by the cushioning conversion machine and/or a ready-to-coil indicator which indicates whether the coiler is in a condition ready to begin coiling a strip of cushioning product. The controller controls the coiler based on input from these indicators. For example, in the preferred embodiment, the controller activates the coiler if the strip-production indicator indicates that a strip of cushioning product is being produced and if the ready-to-coil indicator indicates that the coiler is ready; and the controller deactivates the coiler (after a suitable delay) if the strip-production indicator indicates that cushioning product is no longer being produced by the cushioning conversion machine.

These and other features of the coiler, the guide device, and the controller when used individually in a cushioning conversion system, or collectively as preferred, allow the convenient and consistent coiling of a strip of cushioning product into a coil of cushioning product which may be used for packaging purposes. With particular reference to the guide device and the controller, they possess certain features which are advantageous when making a coil of cushioning product which remains in its coiled configuration when used as a packaging product. However, these features may also be advantageously incorporated into a system where a strip of cushioning product is coiled into a coil configuration, and then later uncoiled for use as a packaging product, such as, for example, the transfer vehicle disclosed in U.S. Pat. No. 4,237,776.

DRAWINGS

FIG. 1 is a side view of a cushioning conversion system 20 according to the present invention, the system 20 including a cushioning conversion machine 22, a coiler 24, a guide device 26, and a controller 28, the cushioning conversion machine 22 being shown loaded with stock material and the coiler 24 being shown with a coil of cushioning product.

FIG. 2 is a top view of the cushioning conversion system 20 as seen from line 2—2 in FIG. 1, the cushioning conversion machine 22 being shown without stock material loaded thereon and the coiler 24 being shown without a coil of cushioning product.

FIG. 3 is an end view of the coiler 24 isolated from the other components of the cushioning conversion system 20, the coiler 24 including a rotating mechanism 48 having a capture device 62.

FIG. 3A is an end view of a modified capture device 62' for the rotating mechanism 48.

FIG. 4 is a front view of certain components of the cushioning conversion machine 22, the coiler 24, and the guide device 26 of the cushioning conversion system 20, as seen from line 4—4 in FIG. 2.

FIG. 5 is an end view of certain components of the coiler 24 and the guide device 26, as seen from line 5—5 in FIG. 4.

FIG. 6 is a perspective view of a section of a strip of cushioning product produced by the cushioning conversion machine 22.

FIG. 7 is a downstream end view of another cushioning conversion system 120 according to the present invention, system 120 include a pair of cushioning conversion machines 122, a pair of coilers 124, and a pair of guide devices 26.

Figure 13:
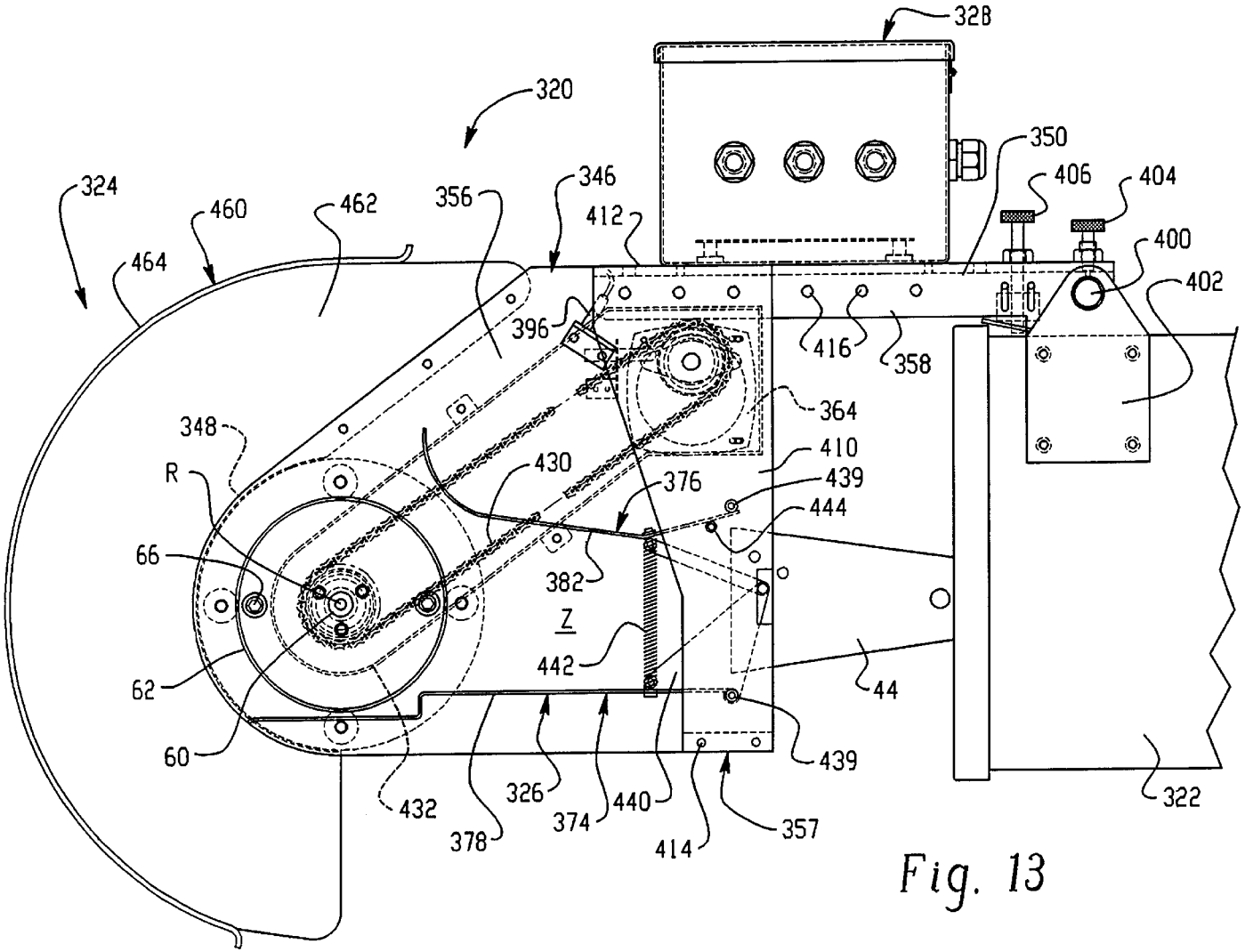

FIG. 13 is a side view of a cushioning conversion system 320 according to the present invention, the system 320 including a cushioning conversion machine 322, a coiler 324, a guide device 326, and a controller 328.

DETAILED DESCRIPTION

Figure 1:
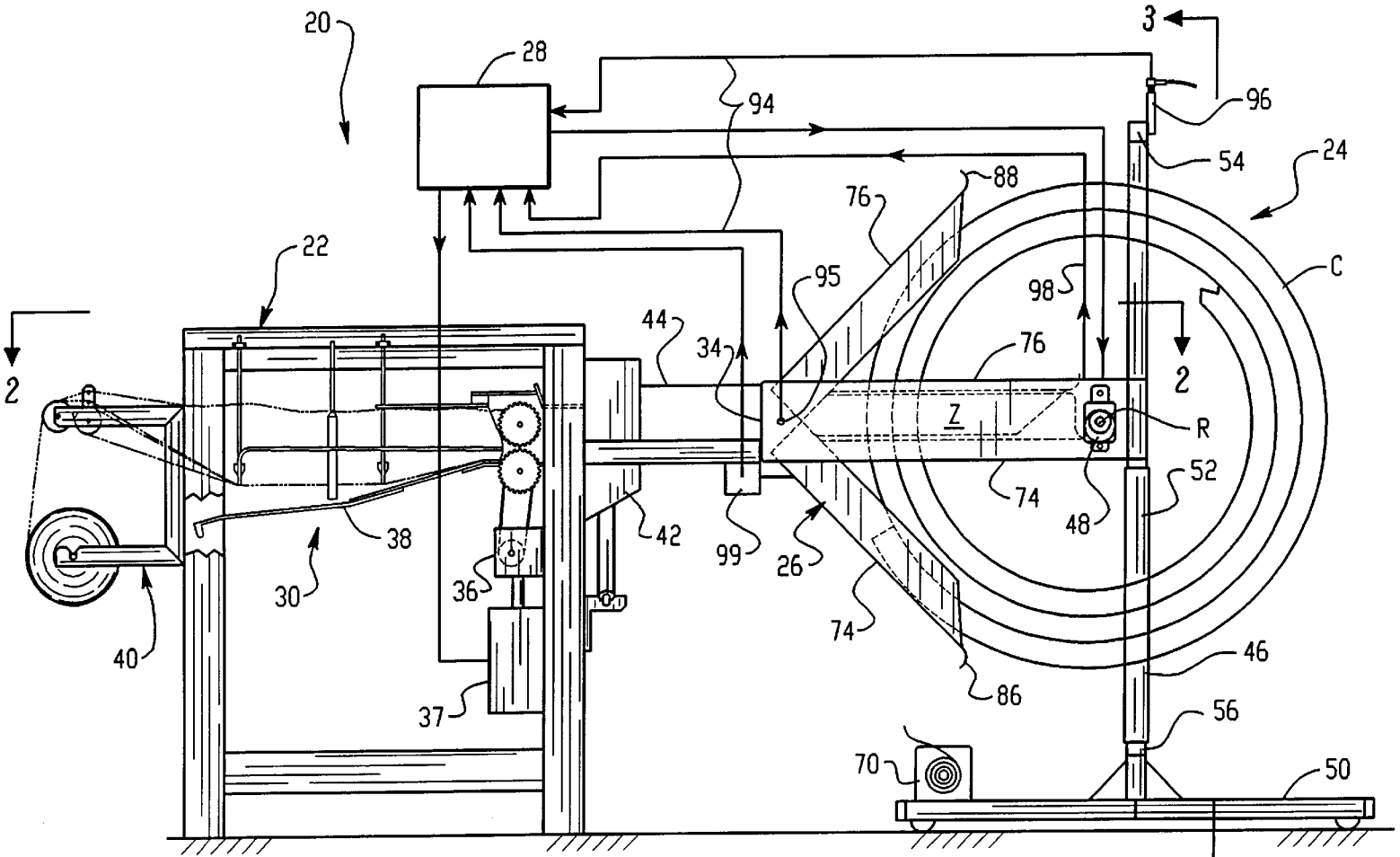
Figure 2:
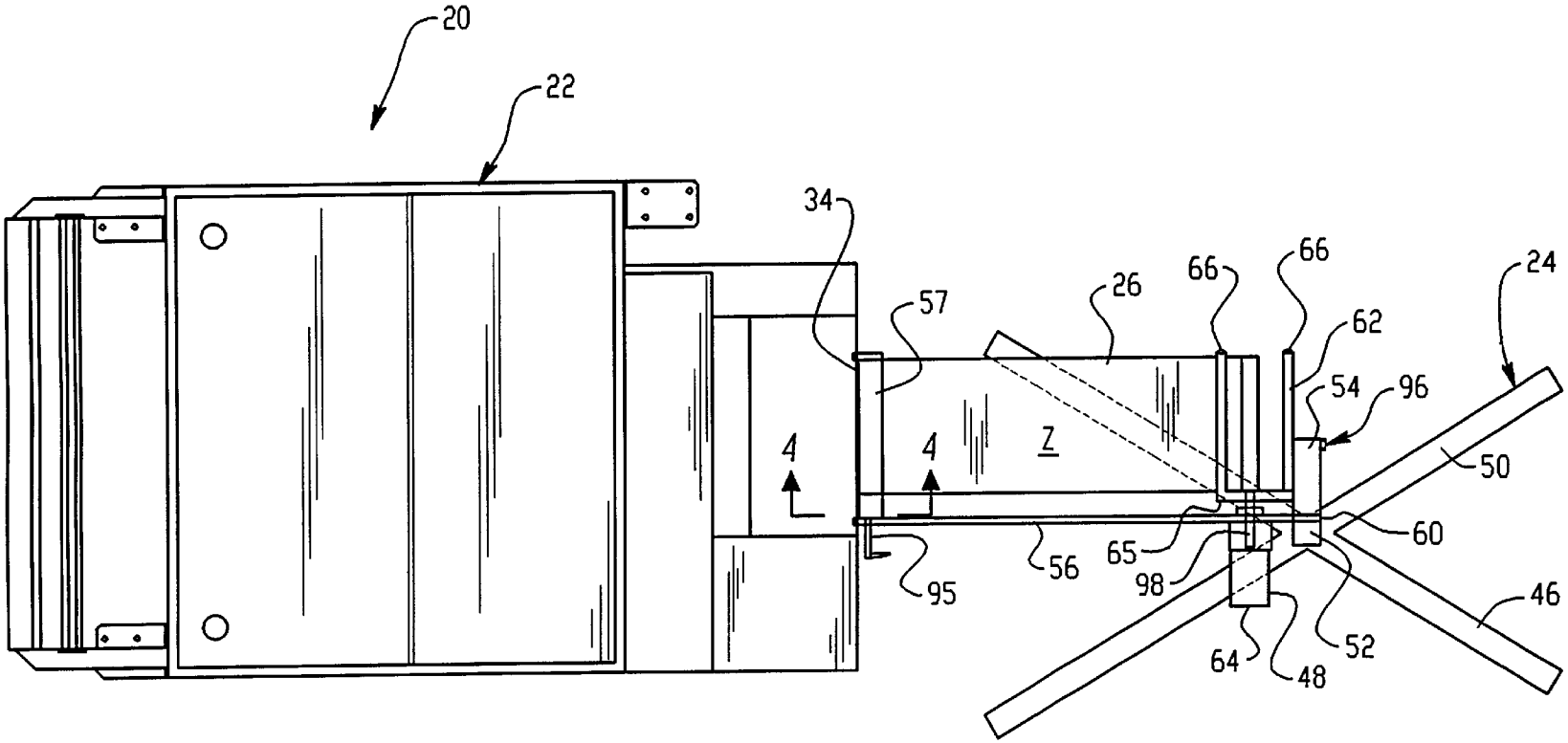

Referring now to the drawings in detail, and initially to FIGS. 1 and 2, a cushioning conversion system 20 according to the present invention is shown. The cushioning conversion system 20 includes a cushioning conversion machine 22, a coiler 24, a guide device 26, and a controller 28. The conversion machine 22 converts a sheet-like stock material into a strip of cushioning product S. The coiler 24 rolls or winds the strip of cushioning product into a coiled configuration to form a coil of cushioning product C and is shaped and positioned to receive the strip of cushioning product as it is emitted from the machine 22 and to allow the coil of cushioning product C to be removed in its coiled configuration. The guide device 26 guides the strip of cushioning product S from the cushioning conversion machine 22 to the coiler 24 and the controller 28 controls the coiler 24 based on the cushioning conversion machine 22. As is explained in more detail below, these features of the coiler 24, the guide device 26, and controller 28 when (used either individually in the cushioning conversion system 20, or collectively as preferred) allow the convenient and consistent coiling of the strip of cushioning product S into the coil of cushioning product C which may be used for packaging purposes.

The cushioning conversion machine 22 shown in the drawings is a self-standing machine in a horizontal orientation, such as is disclosed in U.S. Pat. Nos. 4,026,198; 4,085,662; 4,109,040; 4,237,776; 4,557,716; 4,650,456; 4,717,613; 4,750,896; 4,968,291; 5,061,543; 5,188,581; 5,387,173; 5,542,232; and 5,571,067. However, the cushioning conversion system 20 may alternatively incorporate the non-horizontal and/or non-self standing cushioning conversion machines shown in U.S. Pat. Nos. 5,123.889; 5,211,620; 5,322,477; and 5,468,208; U.S. Pat. Nos. 5,593,376 and 5,607,383, or any other cushioning conversion machine which falls within the scope of the claims.

Figure 6:
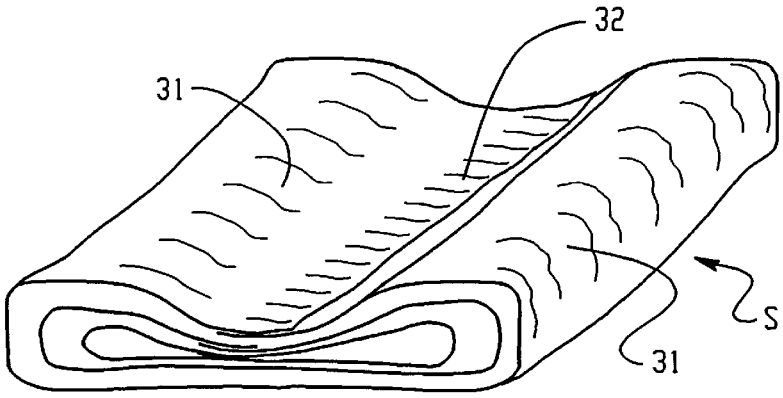

The cushioning conversion machine 22 comprises a conversion assembly 30 which converts a sheet-like stock material into a strip of cushioning product S. (See FIG. 6, showing a section of the strip.) In the preferred and illustrated embodiment, the strip of cushioning product S comprises lateral pillow-like portions 31 and a coined central band 32 therebetween. However, other types of conversion assemblies which convert a sheet-like stock material into a strip of cushioning product having other characteristics, are possible with, and contemplated by, the present invention.

The cushioning conversion machine 22 has an outlet 34 through which the strip of cushioning product S is emitted. The conversion assembly 30 in the illustrated embodiment includes a feed assembly 36, powered by a feed motor 37, and forming assembly 38. The feed assembly 36 advances, and preferably pulls the stock material, and includes a pair of rotating gear-like members 39 driven by the motor 37. The forming assembly 38 forms the stock material inwardly turning the lateral edges of the sheet-like stock material to form a strip having lateral pillow-like portions and a central band therebetween. The gear-like rotating members 39 of the feed assembly 36 preferably coin the central band of the strip during the conversion process to form the strip of cushioning product S.

The cushioning conversion machine 22 in the illustrated embodiment additionally includes a stock supply assembly 40, a severing assembly 42, and an outlet tunnel 44. The stock supply assembly supplies stock material to the conversion assembly 30, or more particularly the forming assembly 38. The severing assembly 42, which is positioned downstream of the conversion assembly 30 and upstream of the coiler 24, cuts or severs the strip of cushioning product after a specified length has been produced. (The length of the strip of cushioning product may be controlled by activating/deactivating the conversion assembly 30, or more particularly the feed assembly 36, as is explained in more detail below.) The strip of cushioning product passes through the outlet tunnel 44 just prior to being emitted from the machine, and the exit of the outlet tunnel 44 forms the outlet 34 of the cushioning conversion machine. A section of the strip of cushioning product is shown in FIG. 6.

The coiler 24 of the cushioning conversion system 20 includes a frame 46 and a rotating mechanism 48 rotatably mounted to the frame 46. As is explained in more detail below, certain portions of the rotating mechanism 48 rotate and may be viewed as defining the center of rotation R of the coiler 24 (although the entire coiler 24 does not rotate). As is also explained in more detail below, the frame 46 positions the rotating mechanism 48 to define an outlet-to-center zone Z extending from the outlet 34 of the cushioning conversion machine 22 to the coiler's center of rotation R and having a width approximately equal to the width of the strip of cushioning product and a height approximately equal to the height of the strip of cushioning product.

Figure 3:
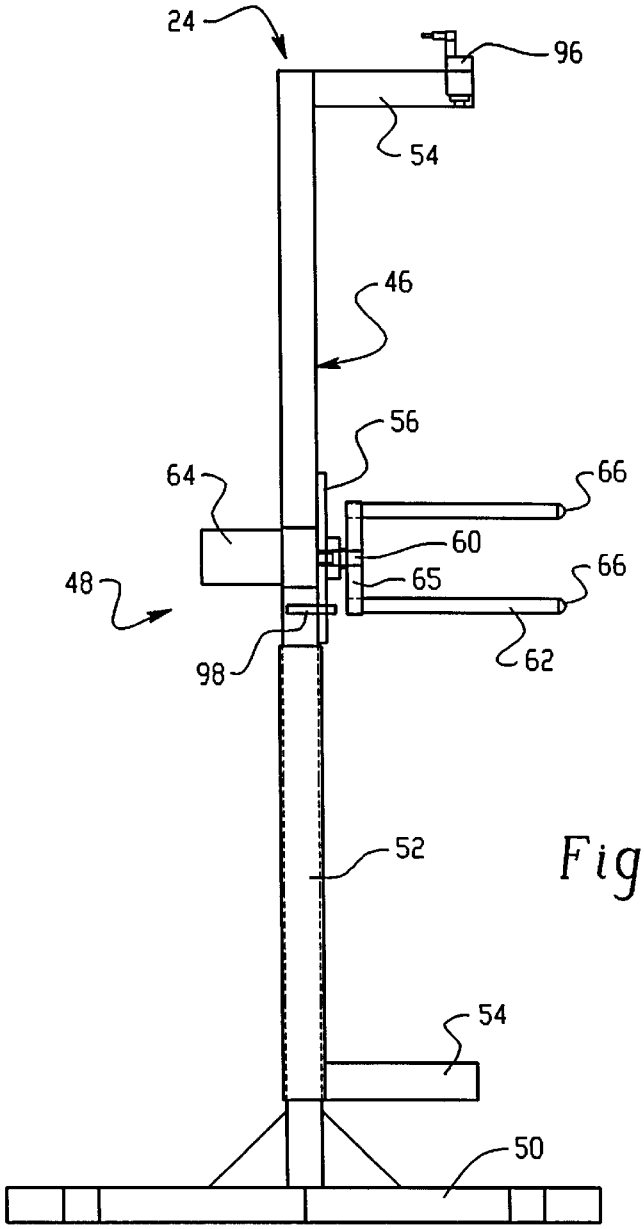

In the illustrated embodiment, the frame 46 is a self-standing structure situated downstream of the cushioning conversion machine's outlet 34. (See FIGS. 1 and 3.) However, the frame 46 could instead be mounted to the cushioning conversion machine 22 or mounted to a nearby wall. In fact, any frame or mounting arrangement which allows the coiler 24 to receive the strip of cushioning product as it is emitted from the outlet 34.of the cushioning conversion machine is possible with, and contemplated by, the present invention.

The illustrated frame 46 includes an X-shaped base 50, a vertical post 52, top/bottom extensions 54, a support panel 56, and a support border 57. The X-shaped base 50 rests on the ground or floor and the vertical post 52 extends upward from the center thereof. (See FIGS. 1–3.) The frame 46 is positioned relative to the cushioning conversion machine 22 so that the vertical post 52 is offset in a transverse direction relative to the outlet-to-center zone Z. (See FIG. 2.)

The top/bottom extensions 54 are attached to the vertical post 52 at heights above/below the outlet-to-center zone Z and they extend transversely so that they are positioned directly above/below the zone Z. (See FIGS. 2 and 3.) As is explained in more detail below, the primary purpose of the extensions 54 is for the positioning of certain components of the controller 28.

The support panel 56 is attached to the vertical post 52 at a height approximately the same as the height of the outlet-to-center zone Z and it extends upstream from the post 52 to the machine outlet 34. Because the vertical post 52 is offset in a transverse direction from the zone Z the support panel 56 is likewise offset. The support panel 56 may be viewed as forming a wall which extends along one transverse side of the outlet-to-center zone Z. (See FIG. 2.) Alternatively, the support panel 56 could take the form of a more expansive wall having a circular shape approximately that (or being slightly larger than) of the completed coil of cushioning product. Such a circular wall would be shaped and positioned to be situated adjacent an axial side of the coil of cushioning product.

The support border 57 resembles a picture frame and comprises four side members forming a boundary or frame which defines a large central rectangular opening. (See FIG. 5.) One of the lateral side members is attached to the upstream end of the support panel 56. (See FIGS. 2 and 4.) The top and bottom side members extend above and below the outlet-to-center zone Z, and the other lateral side member is positioned on the opposite side of the zone Z as the support panel 56. In other words, the outlet-to-center zone Z passes through the large central rectangular opening of the border 57. (See FIG. 5.) The border 57 may be attached solely to the support panel 56, may be attached alternatively or additionally to the cushioning conversion machine, and/or may be otherwise attached to the coiler's frame 46.

As was indicated above, the rotating mechanism 48 is rotatably mounted to the frame 46, and more particularly the support panel 56. (See FIGS. 1–3.) The rotating mechanism 48 includes a rotating shaft 60 which forms the center of rotation R of the coiler 24, a capture device 62 which is attached to and rotates with the shaft 60, and a power source 64 for rotating the shaft 60. The rotating shaft 60 extends through an opening in the support panel 56 and projects in a transverse direction into the outlet-to-center zone Z, in much the same manner as the top/bottom extensions 54. (See FIGS. 2 and 3.) A suitable bearing structure (not specifically shown) may be incorporated into the opening in the panel 56 to.properly support the rotating shaft 60. In any event, in the illustrated embodiment the opening is upstream of the vertical post 52 whereby the coiler's center of rotation R is not aligned with the vertical post 52 and the support panel 56 extends past this center of rotation R. (See FIGS. 1 and 2.)

The capture device 62 is non-rotatably attached to the projecting end of the shaft 60 whereby it is aligned with the outlet 34 of the cushioning conversion machine 22. (See FIGS. 1 and 2.) The capture device 62 is designed to capture the leading end of the strip of cushioning when the coiler 24 is in a ready-to-coil condition. The illustrated capture device 62 includes a connecting hub 65 and at least two capture members 66 projecting perpendicularly therefrom. The hub 65 is an elongated rod or bar attached centrally to, and rotatably driven by, the shaft 60.

The capture members 66 are preferably cylindrical-shaped members symmetrically positioned to extend from the hub 65 into the outlet-to-center zone Z. (See FIGS. 2 and 3.) The capture members 66 are sized and spaced so that they are approximately as long as the strip of cushioning product is wide and so that they are spaced apart approximately as far as the strip of cushioning product is high. The thickness or diameter of the preferably cylindrical-shaped members 66 is selected so that the members will be of a sufficient strength. For example, the capture members 66 may be between nine and eleven inches long, spaced between three and six inches apart, and approximately ¾ inch thick (i.e., a cylindrical member would have a ¾ inch diameter). Additionally or alternatively, the capture members 66 each have substantially the same diameter (i.e., ¾ inch) throughout their axial length.

To place the coiler 24 in a ready-to-coil condition, the capture members 66 of the capture device 62 are aligned in a plane perpendicular to a travel path of the strip of dunnage as it is emitted from the cushioning conversion machine 22 so that the leading end of the strip of cushioning product will pass between the capture members 66. (Compare FIG. 3 wherein the capture members 66 are shown in the ready-to-coil alignment and FIG. 2 wherein the capture members 66 are shown rotated 90°.) When the shaft 60, and thus the capture members 66, are rotated, the capture members 66 will capture the end of the strip so that the remaining portions of the strip may be coiled there around.

Figure 3A:
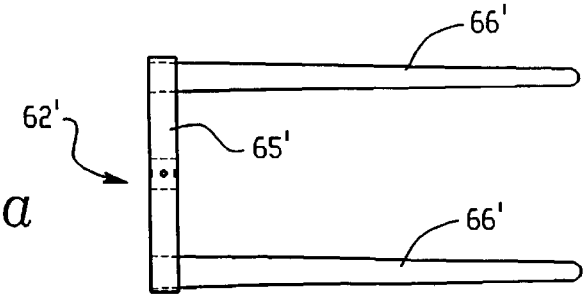

Instead of the capture device 62, the rotating mechanism 48 may incorporate a modified capture device 62' shown in FIG. 3A. The capture device 62' is non-rotatably attached to the projecting end of the shaft 60, aligned with the outlet 34 of the cushioning conversion machine 22, and designed to capture the leading end of the strip of cushioning when the coiler 24 is in a ready-to-coil condition. To this end, the capture device 62' includes a connecting hub 65' and at least two capture members 66' projecting perpendicularly therefrom. The hub 65' may be similar to, the same as, or identical to the hub 65 of the capture device 62.

The capture members 66', like the capture members 66, are symmetrically positioned to extend from the hub 65 into the outlet-to-center zone Z, and are generally sized and spaced in the same manner as the capture members 66'. For example, the capture members 66' may be between nine and eleven inches long and spaced between three and six inches apart. However, in contrast to the capture members 66 (which are cylindrical-shaped members each having the same diameter throughout their axial length), the capture members 66' preferably have a decreasing cross-sectional geometry along their axial length. More particularly, the cross-sectional geometry of the capture members 66' gradually decreases as the members 66' extend from the hub 65'. For example, if the capture members 66' have a circular cross-sectional (as is preferred), the diameter of each member may gradually decrease from ¾ inch (at its proximate end) to ½ inch (at its distal end).

Thus when the rotating mechanism 48 incorporates the capture device 62, the outer surfaces of the capture members 66 form a straight or non-tapering profile around which the strip of cushioning product S is rolled to form the coil of cushioning product. When the rotating mechanism 48 incorporates the capture device 62', the outer surfaces of the capture members 66' form a tapering profile around which the strip of cushioning product S is rolled to form the coil of cushioning product. The tapering of the profile is in the direction of removal of the coil of cushioning product C from the coiler 24. As is explained in more detail below, this tapering profile may aid during the removal of the coil of cushioning product C. It may be further noted at this point that this tapering profile could also be accomplished by two "constant diameter" capture members that, rather than projecting perpendicularly from the hub, are tilted towards the center of rotation R.

The power source 64 for driving or rotating the shaft 60 is mounted on the support panel 56 on the side facing away from the outlet 34 of the cushioning conversion machine 22. (See FIGS. 1–3.) The power source 64 is preferably a motor, more preferably an electric motor, and even more preferably a low speed DC torque motor. A power source 64 with an adjustable current limit is preferable because the motor torque is proportional to motor current whereby the current limit is actually an adjustable torque setting. Alternatively, a fluid-power source 64 with a pressure regulator for torque adjustment is also preferable. Another option is to incorporate a slip clutch into the drive to maintain a constant coiling tension on the strip of cushioning product S.

The coiler 24 may additionally include a taping device 70 for supplying tape to secure the trailing end of the strip of cushioning product to the coil. (See FIG. 1.) In the illustrated embodiment, the taping device 70 is designed for manual dispensing of the tape and manual placement of the tape on the coil. However, an automatic taping device (controlled, for example, by the controller 28) is possible with, and contemplated by, the present invention.

When the coil of cushioning product C has been completely formed and possibly taped, it may be removed or ejected from the coiler 24 by pulling the coil C in a transverse direction away from the support panel 56. This pulling is more easily accomplished if the capture members 66 of the capture device 62 (or the capture members 66' of the capture device 62') are in the ready-to-coil condition whereat they are aligned in a plane perpendicular to a travel path of the strip of dunnage as it is emitted from the cushioning conversion machine 22. (As is explained in more detail below, the controller 28 preferably returns the coiler 24 to the ready-to-coil condition upon deactivation thereof.)

Also, this pulling is more easily accomplished if the capture device 62' is used due to the tapering profile of the outer surfaces of its capture members 66'. Specifically, an initial tug will usually shift the coil C away from the distal end portions of the members 66' (the widest portion of the profile) thereby allowing the coil C to be easily slid off the remaining portions of the members 66' (the less wide portions of the profile).

Alternatively, an automatic ejection system (controlled, for example, by the controller 28) is possible with, and contemplated by, the present invention. In either event, the coiler 24 allows the coil of cushioning product C to be removed in its coiled configuration.

As was briefly explained above, the guide device 26 guides the strip of cushioning product from the cushioning conversion machine's outlet to the coiler 24.

The guide device 26 includes a first or bottom portion 74 and a second or top portion 76. (See FIGS. 1, 2, 4 and 5.) (The terms "bottom", "top", "upward", "downward", "upper", "lower" etc., are used only for the sake of convenience for referring to the illustrated orientation and are not intended to limit the present invention to the illustrated or any other orientation.) The first or bottom portion 74 includes a lower wall 78 and at least one side wall 80 extending upwardly therefrom to form an upwardly opening L-shaped or U-shaped (in cross-section) channel. (See FIG. 5, showing a bottom portion 74 with two side walls 80 and forming a U-shaped channel.) The second or top portion 76 includes an upper wall 82 and at least one side wall 84 extending therefrom to form a downwardly opening L-shaped or U-shaped (in cross-section) channel. (See FIG. 5, showing a top portion 76 with two side walls and forming a U-shaped channel.) In the illustrated embodiment, the walls of each of the portions are substantially straight. However, curved or otherwise shaped walls are possible with, and contemplated by, the present invention.

Figure 4:
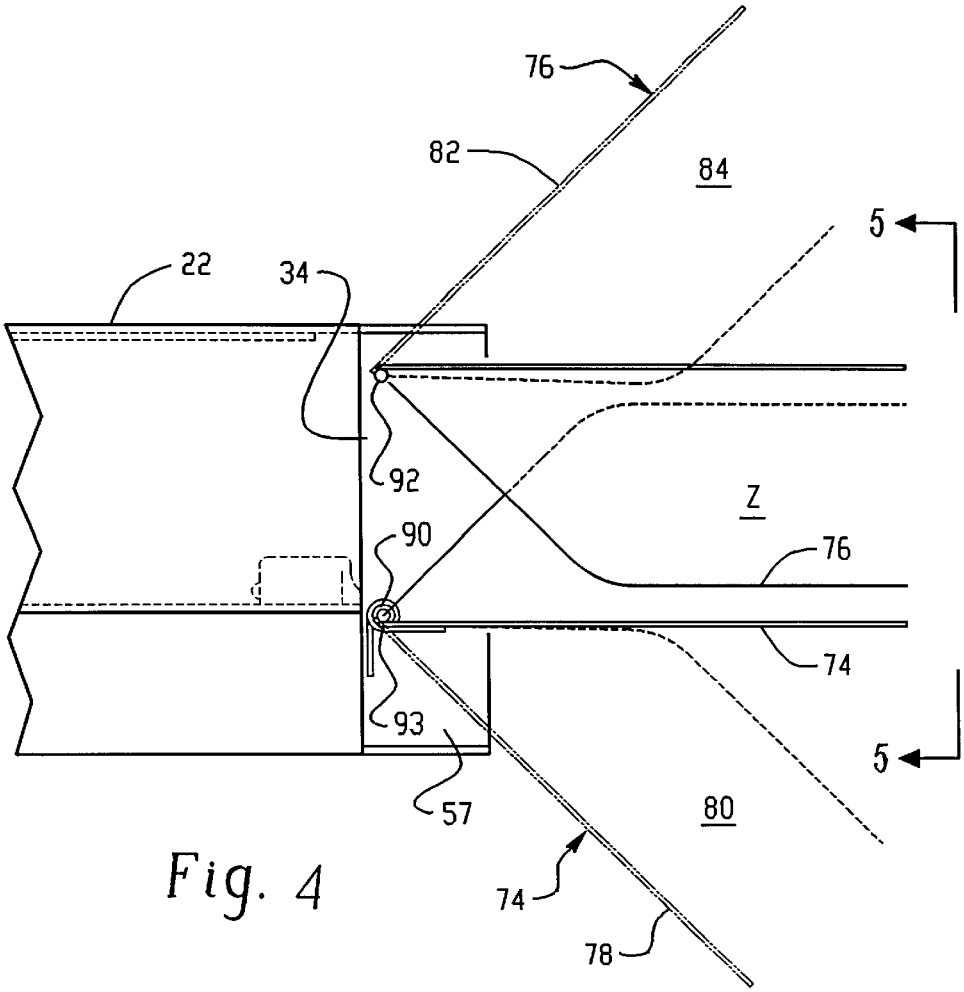
Figure 5:
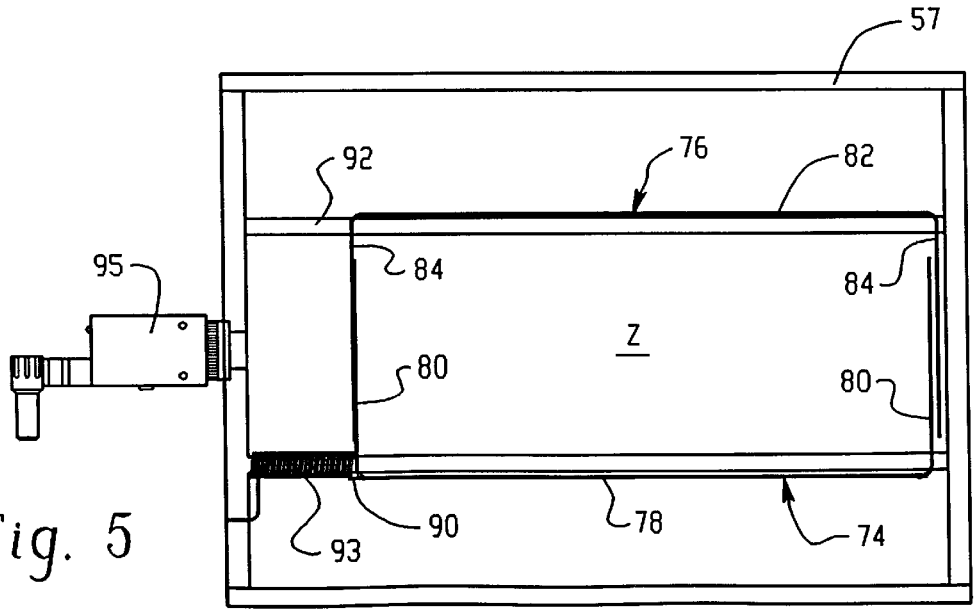

If the portions 74 and 76 each include a pair of side walls to form a U-shaped channel (such as is shown in FIGS. 4 and 5), the bottom side walls 80 are sized and spaced to fit within the top side walls 84 (See FIG. 5) thereby cooperating to define a rectangular channel when in the position shown in FIGS. 4 and 5. If the portions 74 and 76 each include only one side wall to form a L-shaped channel, the respective side walls 80 and 84 depend from opposite edges of the lower/upper walls 78 and 82 thereby cooperating to define a rectangular channel when in the position shown in FIGS. 4 and 5. In either event, the upstream edges of the bottom side walls 80 and the upper side walls 82 are tapered upwardly and downwardly, respectively, in the downstream direction. (See FIG. 4.) The downstream edge of the lower wall 78 includes a curved lip or flange 86 and the downstream edge of the upper wall 82 includes a similar curved lip 88 or extension. (See FIG. 1.)

The guide device 26 further comprises a pivot hinge 90 connected to the first portion 74 and a pivot hinge 92 connected to the second portion 76. (See FIGS. 4 and 5.) The hinges 90 and 92 are connected to an upstream end of the first and second portions 74 and 76, respectively. In the illustrated embodiment, the hinges 90 and 92 are positioned adjacent to the outlet 34 of the cushioning conversion machine 22 and are connected to the support border 57. (See FIGS. 4 and 5.) In any event, the pivotal connection of the first portion 74 and the second portion 76 allows these portions to move to accommodate the strip of cushioning product as the diameter of the coil of cushioning product C increases. (See FIG. 1.)

The portions 74 and 76 are each movable among a coil-begin position whereat the portion accommodates the strip of cushioning product at the beginning of the formation of the coil (shown in phantom in FIG. 1), a coil-complete position whereat the portion accommodates the strip of cushioning product at the completion of the formation of the coil (shown in non-phantom in FIG. 1), and a plurality of positions therebetween. The pivot hinges 90 and 92 allow the portions 74 and 76 to be pivoted from a 0° angle to a non-zero angle in opposite directions. (Specifically, the bottom portion 74 is pivoted downward and the top portion 76 is pivoted upward.) In this manner, the guide device 26 resembles a "duck bill" in the manner in which it opens to accommodate the increasing diameter of the coil of cushioning product C. (See FIG. 1.)

When the portions 74 and 76 are pivoted 0° (or in other words, not pivoted), this corresponds to the coil-begin position and the guide portions 74 and 76 form a chute surrounding the outlet-to-center zone Z, thereby defining a passageway from the cushioning conversion machine's outlet 34 to the capture device 62 (or the capture device 62'). Preferably, the guide portions 74 and 76 are spring biased, gravity biased, or otherwise biased to the coil-begin position. In the illustrated embodiment, the bottom portion 74 is spring biased via a spring 93 and the top portion 76 is gravity biased to the coil-begin position. (See FIGS. 4 and 5.)

When the bottom guide portion 74 is pivoted upward and the top guide portion 76 is pivoted downward at a non-zero angle, this corresponds to a position between the coil-begin position and the coil-complete position, or the coil-complete position itself. The guide portions 74 and 76 then extend from the cushioning conversion machine's outlet 34 to a lower or upper, respectively, circumferential portion of the coil of cushioning product C thereby forming a roughly tangential path relative to the coil. (See FIG. 1.) In the illustrated embodiment, this non-zero angle is an acute angle and is approximately equal to 45°. Specifically, the bottom portion 74 is pivoted downwardly 45° and the top portion 76 is pivoted upwardly 45° relative to the horizontal.

The guide portions 74 and 76 are also each preferably movable to a coil-release position whereat the coil of cushioning product C may be removed from the coiler 24 for use as a packaging product. In the coil-release position, for example, the guide portions 74 and 76 could be pivoted downward and upward beyond the coil-complete position, thereby moving the portions away from the circumference of the coil of cushioning product C. Alternatively, with certain types of guide devices, the coil-release position may not be positioned away from the circumference of the coil of the cushioning product C but instead, for example, have a bias relieved to allow removal of the coil of cushioning product C from the coiler 24.

As was indicated above, the cushioning conversion system 20 comprises a controller 28 which controls the coiler 24 based on the cushioning conversion machine 22. (See FIG. 1.) In the preferred embodiment, the controller 28 includes a strip-production indicator 94 which indicates whether a strip of cushioning product is being produced by the cushioning conversion machine. (See FIG. 1.) The controller 28 then controls the coiler 24 based on input from the strip-production indicator 94. Specifically, the controller 28 activates the coiler 24 if the strip-production indicator 94 indicates that a strip of cushioning product is being produced by the cushioning conversion machine 22 after a period of non-production. The controller 28 also deactivates the coiler 24 upon the strip-production indicator 94 indicating that a strip of cushioning product is not being produced by the cushioning conversion machine 22 after of period of production.

The strip-production indicator 94 may be, as in the illustrated embodiment, a strip sensing device which senses whether a strip of cushioning product is being emitted from the outlet 34 of the cushioning conversion machine 22. In the illustrated embodiment, the strip-production indicator 94 includes an upstream strip sensor 95 which senses whether the strip is present at an upstream location and a downstream strip sensor 96 which senses whether the strip is present at a downstream location. (See FIG. 1.) The upstream strip sensor 95 is mounted at an upstream portion of the support panel 56 or on one of the vertical side members of the support border 57 (see FIGS. 2, 4 and 5) whereby the upstream location is upstream of the coiler's center of rotation R and adjacent the cushioning conversion machine's outlet 34. The downstream strip sensor 96 is mounted on the top/bottom extension 54 of the coiler frame 46 (see FIGS. 1–3) whereby the downstream location is adjacent the coiler's center of rotation R and slightly downstream thereof. In this manner, the downstream location is positioned to insure that the leading end of the strip of cushioning product is correctly positioned relative to the capture device 62 (or the capture device 62').

The controller 28 activates the coiler 24 (i.e., energizes the motor 64 of the rotating mechanism 48) when both the sensors 95 and 96 sense that the strip of cushioning product is present at both the upstream location and the downstream location. This insures that the leading end of the strip of cushioning product is correctly positioned relative to the capture device 62 (or the capture device 62') and that the strip of cushioning product is long enough to coil. The controller 28 deactivates the coiler 24 when the upstream sensor 95 senses that the strip of cushioning product is no longer present (i.e., its trailing end has passed the upstream location) after a set period of time corresponding to the period of time necessary to insure that the trailing end portion of the strip of cushioning product is coiled onto the coil of cushioning product C.

The controller 28 also includes a ready-to-coil indicator 98 which indicates whether the coiler 24 is in its ready-to-coil condition and the controller controls the coiler 24 based on input from the ready-to-coil indicator 98. (See FIGS. 1 and 3.) Specifically, the controller 28 only activates the coiler 24 if the ready-to-coil indicator indicates that the coiler 24 is in the ready-to-coil condition. (In the preferred embodiment, the coiler 24 is in the ready-to-coil condition when the capture members 66 are aligned in a plane perpendicular to the a travel path of the strip of cushioning product as it is emitted from the cushioning conversion machine 22 so that the leading end of the strip of cushioning product will pass between the capture members 66.) The controller 28 may automatically return the coiler 24 to the ready-to-coil condition upon the occurrence of certain events in the coiling cycle. For example, the controller 28 may automatically return the coiler 24 to the ready-to-coil condition upon deactivation of the coiler 24. (This also insures an easy removal or ejection of the coil of cushioning product C from the coiler 24.)

The controller 28 may also control the conversion assembly 30 of the cushioning conversion machine 22 to produce a strip of cushioning product of predetermined length. (See FIG. 1.) This control may be accomplished by activating and deactivating the feed assembly 36 (for example, by energizing the feed motor 37) and/or the severing assembly 42. The length of the cushioning product being produced may be determined by the timer disclosed in U.S. Pat. No. 4,619,635, the length measuring device disclosed in U.S. Pat. No. 5,571,067, or any other suitable mechanism or means. The length measuring device may be the same as that used when the machine 22 is operated without the coiler 24 or the controller 28 may include a separate length measuring device dedicated to situations where the coiler 24 is being used.

Additionally or alternatively, the controller 28 may control the conversion assembly 30 of the cushioning conversion machine to produce a coil of cushioning product C of a predetermined diameter. To accomplish this control, this end, the controller 28 may include a coil-diameter indicator 99 to indicate the diameter of the coil of cushioning product C. In the illustrated embodiment, the coil-diameter indicator 99 senses when a coil of certain diameter has been formed (it is preferably adjustable for sensing various diameters). Based on the input from the coil-diameter indicator 99, the controller 28 would deactivate the conversion assembly 30 and/or the coiler 24.

Referring now to FIGS. 7–11, another cushioning conversion system 120 according to the present invention is shown. The cushioning conversion system 120 includes two cushioning conversion machines 122, a machine stand 123 and two coilers 124. The cushioning conversion machines 122 each convert a sheet-like stock material into a strip of cushioning product S and each of the coilers 124 rolls the strip of cushioning product S into a coiled configuration to form a coil of cushioning product C. The coilers 124 are each shaped and positioned to receive the strip of cushioning product S as it is emitted from the corresponding machine 122 and each allows the coil of cushioning product C to be removed in its coiled configuration.

The illustrated cushioning conversion system 120 includes two guide devices 26 (one for each machine/coiler) which are preferably the same as those used in the cushioning conversion system 20. Also, although not specifically shown in the drawings, the cushioning conversion system 120 preferably includes either a single controller (which controls both machines 122 and both coilers 124) or a pair of controllers (which each control a respective machine 122 and coiler 124). Such a controller or controllers are preferably the same as the controller 28 used in the cushioning conversion system 20.

Figure 7:
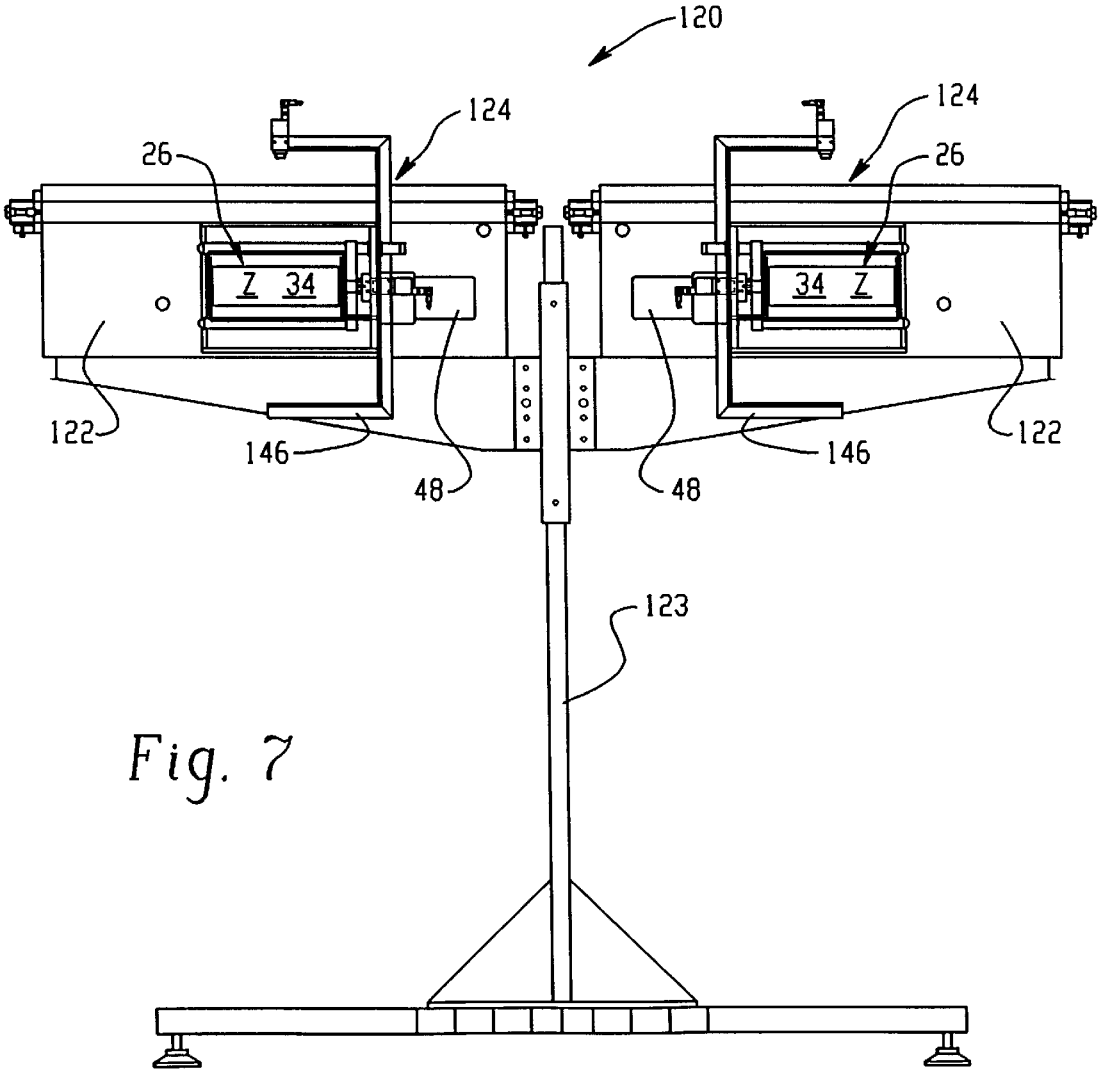
Figure 8:
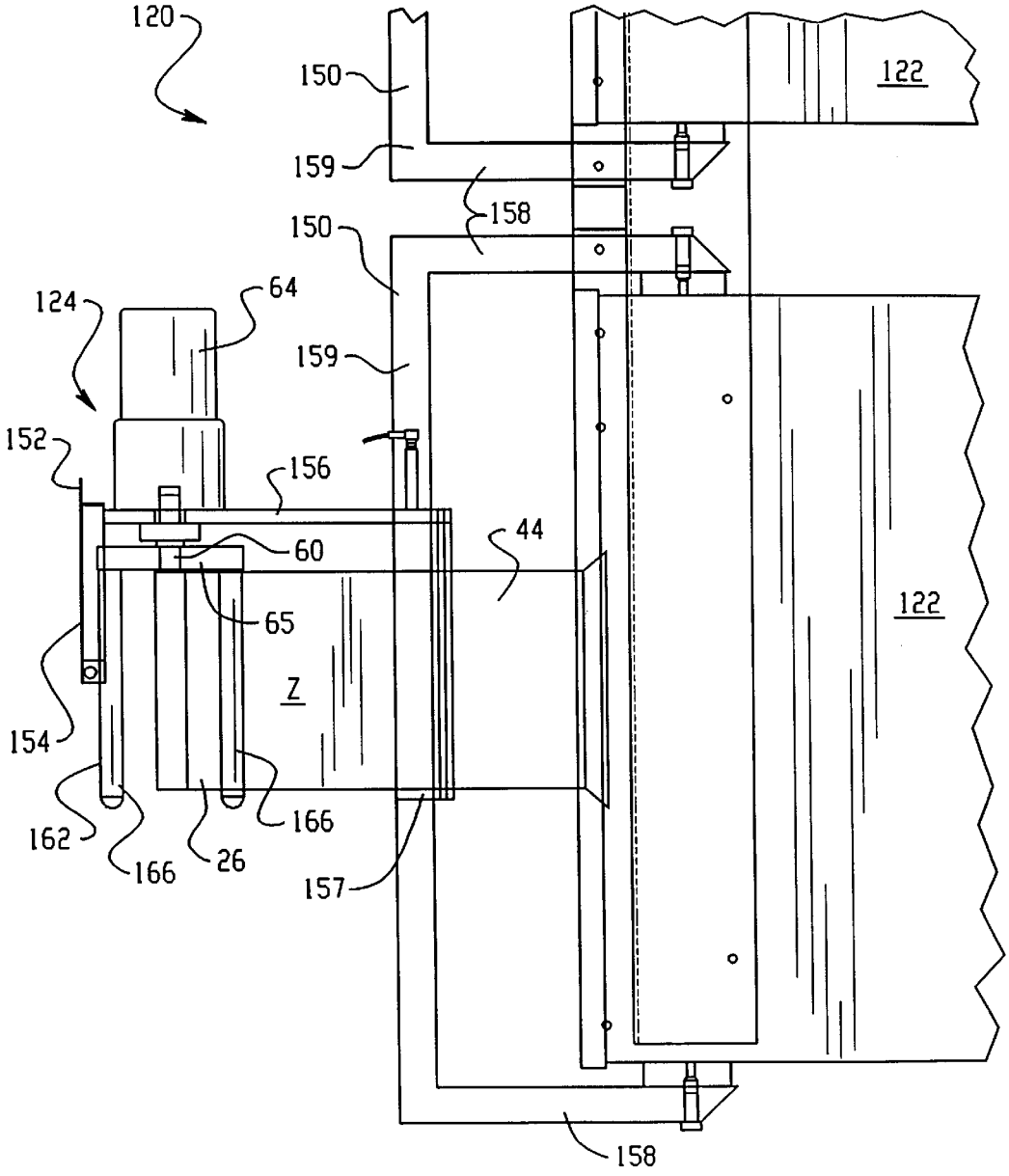
FIG. 8 is a partial top view of the cushioning conversion system 120.

The illustrated cushioning conversion system, the machines 122 are horizontally oriented machines and are of the same general design as the horizontally oriented machines disclosed in U.S. Pat. Nos. 5,123,889; 5,211,620; 5,322,477; and 5,468,208. The cushioning conversion machines 122 are not self-standing, but instead are supported by the stand 123 which symmetrically positions the machines relative to each other. (FIG. 7.) However, the cushioning conversion system 120 may alternatively incorporate non-horizontal and/or self standing cushioning conversion machines such as the cushioning conversion machine 22 discussed above, the machines shown in U.S. Pat. Nos. 5,593,376 and 5,607,383, or any other cushioning conversion machine which falls within the scope of the claims. Additionally or alternatively, the cushioning conversion system 120 may include only one cushioning conversion machine or more than two cushioning conversion machines.

Each cushioning conversion machine 122 preferably comprises a conversion assembly 30 (not shown) which converts a sheet-like stock material into a strip of cushioning product S and each machine has an outlet 34 through which the strip of cushioning product S is emitted. Each of the cushioning conversion machines 122 may additionally include a stock supply assembly 40 (not shown), a severing assembly 42 (not shown), and an outlet tunnel 44. The exit end of the tunnel 44 forms the outlet 34 of the machine 122.

Each of the coilers 124 of the cushioning conversion system 120 includes a frame 146 and a rotating mechanism 48 rotatably mounted to the frame 146. The rotating mechanism of the coiler 124 is essentially the same as the rotating mechanism of the coiler 24. (Accordingly, like reference numerals are used.) Thus, certain portions of the rotating mechanism 48 rotate and may be viewed as defining the center of rotation R of the coiler 124 (although the entire coiler 124 does not rotate).

The frame 146 positions the rotating mechanism 48 to define an outlet-to-center zone Z extending from the outlet 34 of the cushioning conversion machine 122 to the coiler's center of rotation R. This zone has a width approximately equal to the width of the strip of cushioning product S and a height approximately equal to the height of the strip.

The coiler's frame 146 is not a self-standing structure but instead is pivotally mounted to the cushioning conversion machine 122. (See FIG. 10.) In the illustrated embodiment, this mounting is done in such a manner that the coilers 124 are symmetrically situated relative to each other. (See FIG. 7.) In any event, the illustrated frame 146 includes a square-cornered U-shape base 150, a vertical post 152, top/bottom extensions 154, a support panel 156, and a support border 157.

The side legs 158 of the U-shape base 150 (i.e., the legs defining the sides of the "U") are pivotally coupled to the machine 122. When the frame 146 is in its operating position, the side legs 158 extend in an outward or downstream direction away from the machine 122 and the connecting leg 159 of the U-shape base 150 (i.e., the leg defining the bottom of the "U") extends above the exit end of the tunnel 44. (See FIG. 10.)

The rotating mechanism 48 is aligned with the outlet 34 of the cushioning conversion machine 122 when the frame 146 is in its operating position. When the frame 146 is moved from this operating position, the rotating mechanism 48 is no longer aligned with the outlet 34 whereby the machine 122 may be used without the coiler 124, if necessary or desired. Also, the pivotal movement of the frame 146, and thus the coiler 124, may aid in allowing access to certain assemblies of the cushioning conversion machine 122, such as its severing assembly. Furthermore, in packaging sites with space restraints, the frame 146 occupies less space than the self-standing frame 46 of the coiler 24.

Figure 9:
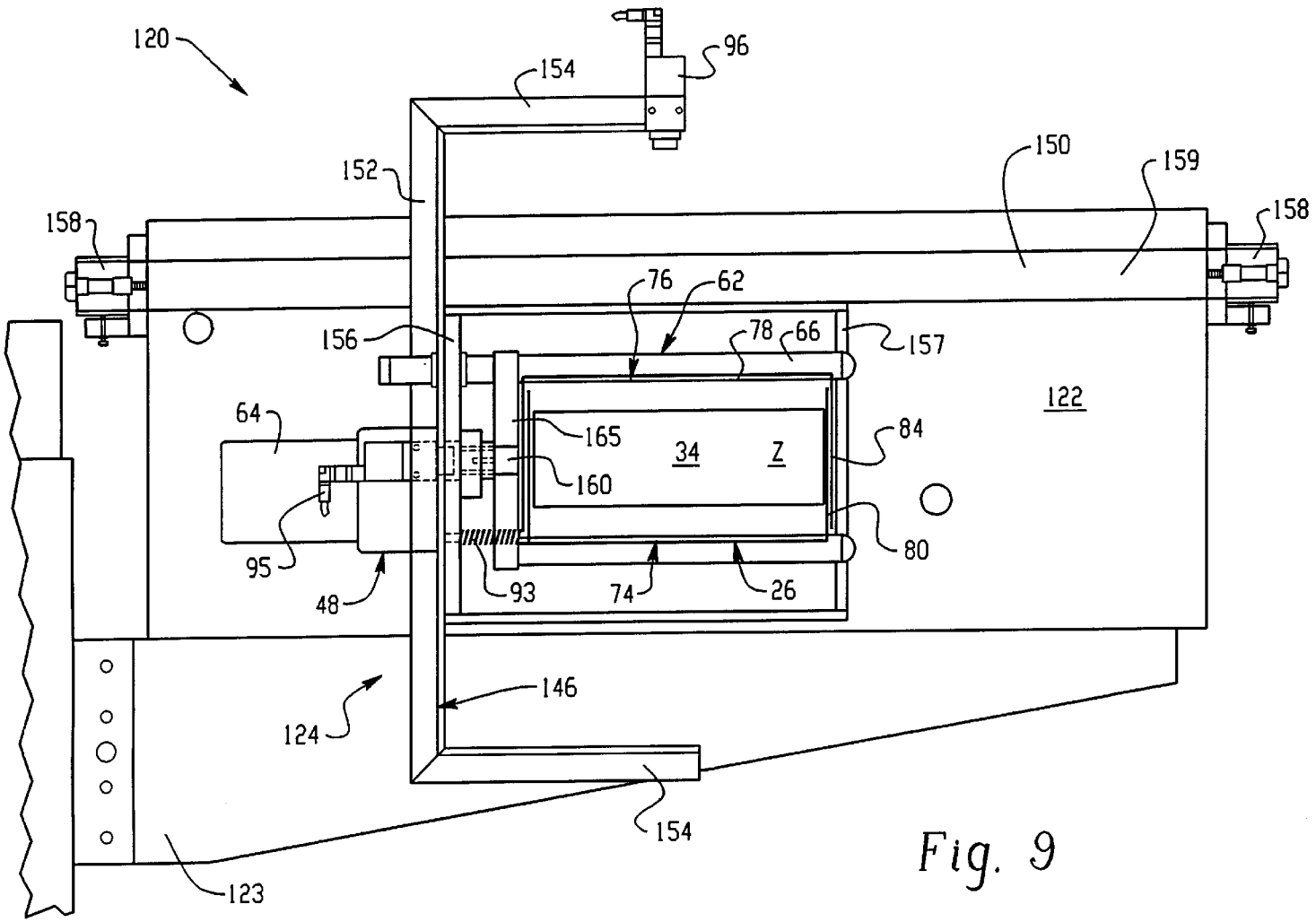
FIG. 9 is a partial enlarged downstream end view of the cushioning conversion system 120.
Figure 10:
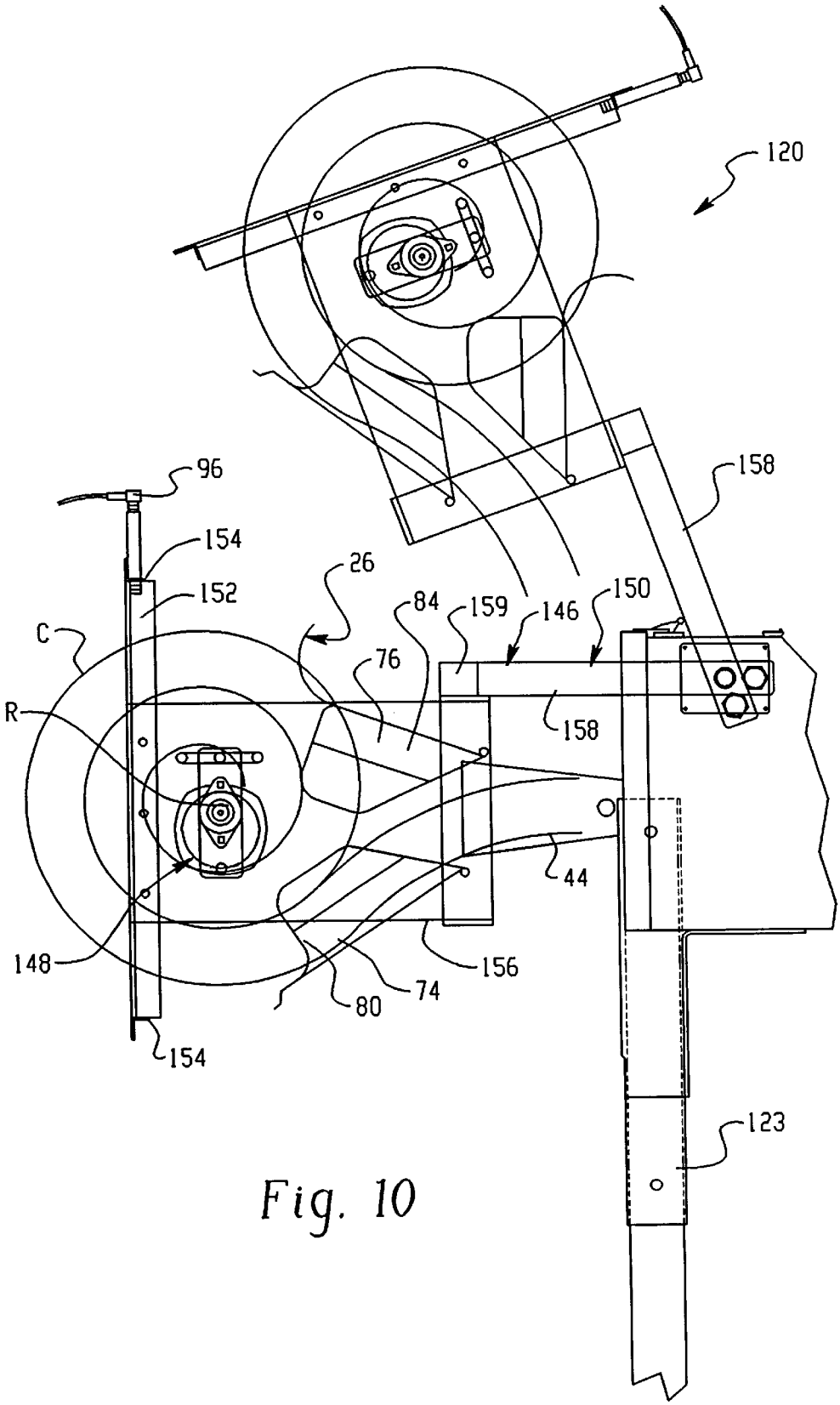
FIG. 10 is an enlarged partial side view of the cushioning conversion system 120.
Figure 11:
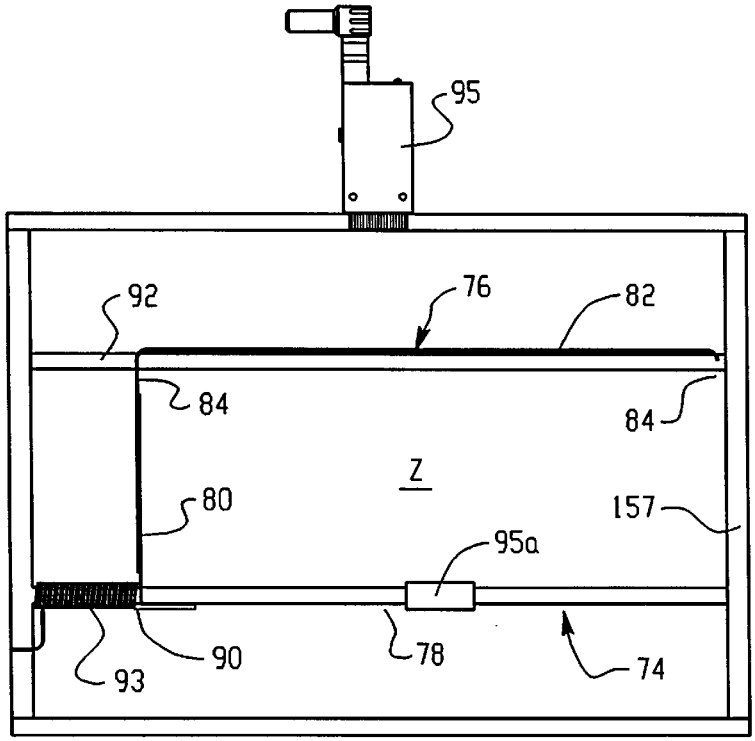
FIG. 11 is an end view of certain modified components of the coiler 124 and the guide device 26.

The support border 157, like the border 57 resembles a picture frame and comprises a four side members forming a boundary or frame which defines a large central rectangular opening. Its top member is attached to the connecting leg 159 of the base 150. (FIG. 9.) As with the border 57, the top and bottom side members of the border 157 extend above and below the outlet-to-center zone Z, and the other lateral side members are positioned on the opposite lateral sides of the zone Z. In other words, the outlet-to-center zone Z passes through the large central rectangular opening of the border 157.

The support panel 156 is attached to one of the lateral side members of the border 157 and extends downstream therefrom. In the illustrated embodiment, the support panel 156 is attached to the "inner" lateral side member, or the side member closest to the other cushioning conversion machine 122 or the other coiler 124. In this manner, the support panel 156 is positioned at a height approximately the same as the height of the outlet-to-center zone Z. Because the lateral side member of the border 157 is offset in a transverse direction from the outlet-to-center zone Z, the support panel 156 is likewise offset. Accordingly, the support panel 156 may be viewed as forming a wall which extends along one transverse side of the outlet-to-center zone Z. (See FIG. 8.)

The vertical post 152 is attached to the downstream edge of the support panel 156 and extends above/below the panel 156, the border 157, and/or the outlet-to-center zone Z. The top/bottom extensions 154 are attached to the vertical post 152 at heights above/below the outlet-to-center zone Z and they extend transversely so that they are positioned directly above/below the zone Z. (See FIG. 9.) As is with the extensions 54 in the cushioning conversion system 20, the primary purpose of the extensions 154 is for the mounting of the downstream strip sensor 96.

The coiler 124 may additionally include a taping device, such as the manual taping device 70 of the coiler 24, or an automatic taping device, for supplying tape to secure the trailing end of the strip of cushioning product to the coil. Additionally or alternatively, the coiler 124 could include an automatic ejection system such as discussed above in connection with the coiler 24. In any event, when the coil of cushioning product C has been completely formed and possibly taped, it may be removed or ejected from the coiler 124 by moving the coil in a transverse direction away from the support panel 156 whereby the coiler 124 allows the coil of cushioning product C to be removed in its coiled configuration.

As was indicated above, the cushioning conversion system 120 preferably includes two guide devices 26 (one for each machine 122/coiler 124) which are preferably the same as those used in the cushioning conversion system 20. In the embodiment in FIGS. 7–10, the portions 74 and 76 each include a pair of side walls 80 and 84 whereby their walls form a U-shaped channel. In the modified version of the support panel 257 shown in FIG. 11, the portions 74 and 76 each include only one side wall 80 and 84 to form a L-shaped channel. The outer most side walls (i.e., furthest away from the support panel 157) of the U-shaped design have been eliminated to allow a more efficient and/or convenient removal of the completed coil of cushioning product C.

As was also indicated above, the cushioning conversion system 120 preferably includes a control system comprising either a single controller (which controls both machines 122 and both coilers 124) or a pair of controllers (which each control a respective machine 122 and coiler 124). This control system preferably includes, for each cushioning conversion machine 122 and coiler 124, a strip-production indicator, a ready-to-coil indicator, and/or a coil-diameter indicator, such as the indicators 94, 98 and 99 discussed above. The strip-production indicator may include an upstream sensor 95 and a downstream sensor 96. In FIGS. 7–10, the upstream sensor 95 is mounted at an upstream portion of the support panel 156 and the downstream sensor 96 is mounted to the extensions 154 of the coiler frame 146. In the modified mounting arrangement shown in FIG. 11, the upstream sensor 95 is mounted to the top member of the support border 157. The top wall 82 of the guide device portion 76 includes an appropriate opening and a reflector strip 95a is positioned on the inner surface of the bottom wall 78 of the guide device portion 74.

Figure 12:
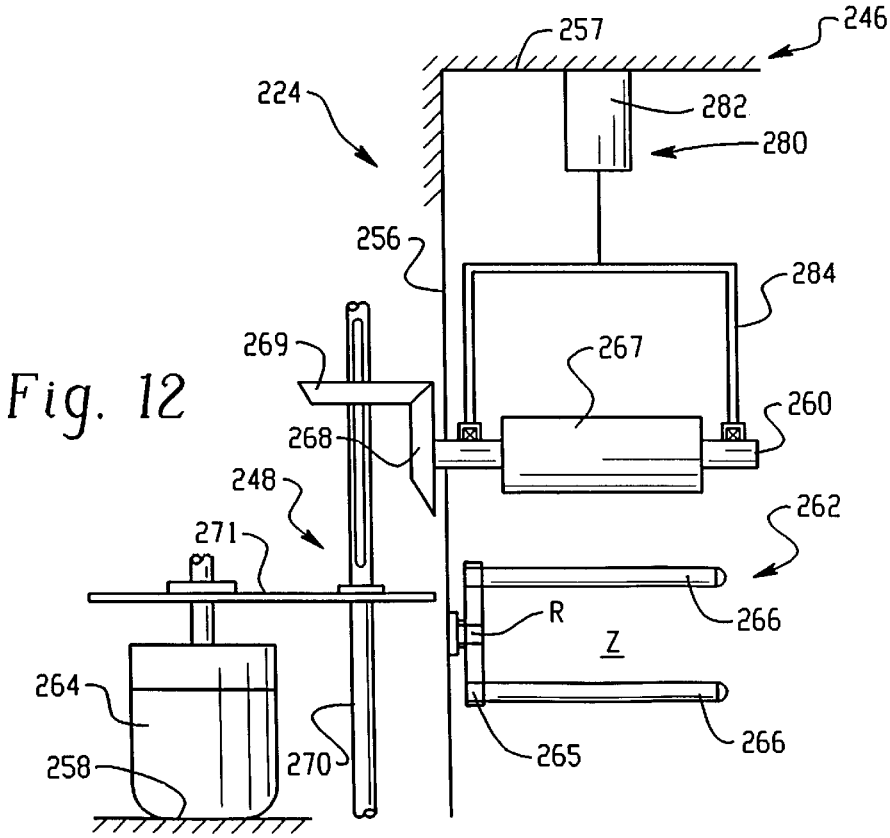
FIG. 12 is a schematic downstream end view of another coiler 224 which may be incorporated into a cushioning conversion system according to the present invention.

Referring now to FIG. 12, a coiler 224 is schematically shown which may be used instead of the coilers 24 and 124 in the cushioning conversion systems 20 and 120 or in any other cushioning conversion system which falls within the scope of the claims. In addition to the coiler 224, such a cushioning conversion system could include at least one cushioning conversion machine, such as machines 22 and 122, and a controller, such as controller 28. However, such a cushioning conversion system would preferably not include a guide device, such as the guide device 26 used in the cushioning conversion systems 20 and 122.

In a cushioning conversion system including the coiler 224, the cushioning conversion machine would convert a sheet-like stock material into strip of cushioning product S and the coiler 224 would roll or wind the strip of cushioning product S into a coiled configuration to form a coil of cushioning product C. The coiler 224 is designed to receive the strip of cushioning product S as it is emitted from the cushioning conversion machine 122 and allows the coil of cushioning product C to be removed in its coiled configuration.

The coiler 224 includes a frame 246 (which is only partially schematically shown) and a rotating mechanism 248. The frame 246 includes a support panel 256 which, like the support panels 56 and 156, may be viewed as forming a wall which extends along one transverse side of the outlet-to-center zone Z. The frame 246 also includes other support panels 257 and 258 (only partially schematically shown) which are used to support certain components of the rotating mechanism 248. These support panels 257 and 258 may be incorporated into a self-standing frame such as the frame 46 or a machine-supported frame such as the frame 146, in the coilers 24 and 124 discussed above.

The rotating mechanism 248, like the rotating mechanism 48, includes a rotating shaft 260, a capture device 262, and a power-source or motor 264. The capture device 262, like the capture device 62 or 62', comprises a connecting hub 265 and capture members 266 which may be of the same construction as the hub 65 or 65' and the capture members 66 or 66'. The capture device 262 is rotatably mounted on the support panel 256 in alignment with the machine's outlet 34 (the outlet 34 is not shown in FIG. 12, but this alignment is shown in FIGS. 2 and 9 in connection with the coilers 24 and 124) and may rotate relative to the support panel 256 during operation of the coiler 224. In the coiler 224, the rotational axis of the capture device 262 may be viewed as defining the center of rotation R of the coiler 224 (although the entire coiler 224 does not rotate). Thus, the frame 246 may be viewed as positioning the rotating mechanism 248 to define an outlet-to-center zone Z extending from the outlet of the cushioning conversion machine to the coiler's center of rotation R. In contrast to the coilers 24 and 124, the rotating shaft 260 does not rotatably drive the capture device 262 in the coiler 224. Instead, the rotating mechanism 248 additionally includes a riding drive roller 267 which is fixedly mounted to the rotating shaft 260. The drive roller 267 coils the strip of cushioning product around the capture device by pushing the outer diameter of the coil in the coiling direction. In this manner, a constant coiling speed may be maintained. In the coilers 24 and 124, the coiling speed may vary as the diameter of the coil of cushioning product changes.

The rotating shaft 260 extends through a slot in the support panel 256 and projects in a transverse direction into the outlet-to-center zone Z. The slot is elongated in a direction perpendicular to the projection of the rotating shaft. The support panel 256 includes such an elongated slot, rather than a bearing opening such as in the support panel 56, to allow controlled linear movement (vertical in the illustrated embodiment) of the rotating shaft 260 during operation of the coiler 224. The rotating shaft 260, and thus the drive roller 267, are transversely offset (i.e., above in the illustrated embodiment) from the outlet 34. (Again, the machine's outlet 34 is not shown in FIG. 12, but this transverse offsetting is shown in FIGS. 2 and 9 in connection with the coilers 24 and 124.)

In the illustrated embodiment, the rotating shaft 260 is coupled to the motor 264 via bevel gears 268 and 269, a connecting shaft 270, and a sprocket chain 271. During operation of the rotating mechanism 248, the output shaft of the motor 264 drives the sprocket chain 271 which in turn rotates the vertical connecting shaft 270. The bevel gear 269, which is non-rotatably mounted to the connecting shaft 270, is thus rotated with the connecting shaft 270 and in turn rotates the bevel gear 268, which is non-rotatably mounted to the rotating shaft 260. The bevel gears 268 and 269, and the connecting shaft 270 are designed to allow controlled linear movement of the bevel gears in the same direction as the rotating shaft 260.

The rotating mechanism 248 further includes a carrier 280 which adjusts the position of the drive roller 267 relative to the capture device 262 to accommodate the changing diameter of the coil of cushioning product C. In the illustrated embodiment, the carrier 280 comprises a fluid-powered or other type of cylinder 282 having an extendable/retractable piston. The piston 282 is attached to a yoke 284 which is mounted to the rotating shaft 260 in a manner allowing rotation of the shaft relative to the yoke.

During operation of a cushioning conversion system incorporating the coiler 224, the leading end of the strip of cushioning product is positioned between the capture members 266 of the capture device 262, either manually or by automatic activation/deactivation of the cushioning conversion machine as controlled by the system's controller. Preferably, the capture device 262 is rotated to at least provide one winding of the strip of cushioning product around the capture members 266. The piston of the cylinder 282 is extended to cause the drive roller 267 to contact the strip of cushioning product around the capture members 266 and to apply a sufficient mount of pressure thereon. (The pressure may be provided solely by gravity, i.e., the weight of the drive roller, or may be supplemented by pressure from the cylinder 282.) The drive roller 267 is then rotated thereby causing the strip of cushioning product to continue to be coiled around the capture device 262. As the diameter of the coil of cushioning product C increases, the drive roller 267 "floats" to accommodate the coil's changing diameter.

If a cushioning conversion system incorporating the coiler 242 includes a controller (such as the controller 28 discussed above), the controller may control the machine's conversion assembly to produce a strip of cushioning product of predetermined length and/or to produce a coil of cushioning product of a predetermined diameter. After the coiling stage is completed, the trailing end of the strip of cushioning product is preferably secured to the coil, such as with the taping device 70 discussed above, or any other manual or automatic taping device. The piston of the cylinder 282 is then retracted to cause the drive roller 267 to move away from the outer diameter of the coil of cushioning product, thereby allowing the coil to be removed from the coiler 242 in its coiled configuration. The completed coil of cushioning product C may be manually removed or ejected via an automatic ejection system.

Referring now to FIG. 13, another cushioning conversion system 320 according to the present invention is shown. The cushioning conversion system 320 includes a cushioning conversion machine 322 and a coiler 324. Although not specifically shown in the drawings, the machine 322 may be mounted on a mounting stand, such as the mounting stand 123 discussed above. In any event, the cushioning conversion machine 322 converts a sheet-like stock material into a strip of cushioning product S and the coilers 324 rolls the strip of cushioning product S into a coiled configuration to form a coil of cushioning product C. The coiler 324 is shaped and positioned to receive the strip of cushioning product S as it is emitted from the corresponding machine 322 and to allow the coil of cushioning product C to be removed in its coiled configuration.

The illustrated cushioning conversion system 320 further includes a guide device 326 and a controller 328. The guide device 326 may be of the same or similar design as the guide device 26 described above. Likewise, the controller 328 may perform the same functions as the controller 328 described above. Alternatively, as is shown and/or preferred, the guide device 326 is of a modified construction and the controller 328 controls the cushioning conversion machine 322 and the coiler 324 in a modified manner, as is explained in more detail below.

In the illustrated cushioning conversion system 320, the machine 322 is a horizontally oriented machine of the same general design as the horizontally oriented machines disclosed in U.S. Pat. Nos. 5,123,889; 5,211,620; 5,322,477; and 5,468,208. However, the cushioning conversion system 320 may alternatively incorporate non-horizontal and/or self standing cushioning conversion machines such as the cushioning conversion machine 22 discussed above, the machines shown in U.S. Pat. Nos. 5,593,376 and 5,607,383, or any other cushioning conversion machine which falls within the scope of the claims.

The cushioning conversion machine 322 preferably comprises a conversion assembly 30 (not shown) which converts a sheet-like stock material into a strip of cushioning product S and an outlet 34 through which the strip of cushioning product S is emitted. The machine 322 may additionally include a stock supply assembly 40 (not shown), a severing assembly 42 (not shown), and an outlet tunnel 44. In the illustrated embodiment, the exit end of the tunnel 44 forms the outlet 34 of the machine 122.

The coiler 324 includes a frame 346 and a rotating mechanism 348 rotatably mounted to the frame 346. Except for the mounting of its motor 364 (discussed in detail below), the rotating mechanism 348 may be the same as the rotating mechanisms 48 discussed above. (Accordingly, like reference numerals are used for the shaft 60, the capture device 62, the capture members 66, etc.) As with the mechanism 48, certain portions of the rotating mechanism 348 rotate and may be viewed as defining the center of rotation R of the coiler 324 (although the entire coiler 324 does not rotate). The frame 346 positions the rotating mechanism 348 to define an outlet-to-center zone Z extending from the outlet 34 of the cushioning conversion machine 322 to the coiler's center of rotation R. This zone has a width approximately equal to the width of the strip of cushioning product S and a height approximately equal to the height of the strip.

The coiler's frame 346 is not a self-standing structure but instead is pivotally mounted to the cushioning conversion machine 122 so that the coiler 324 may be selectively moved between an operating position whereat the rotating mechanism 348 is aligned with the outlet 34 and an elevated position whereat the machine 322 may be used without the coiler 342 if necessary or desired. As with the pivoting frame 246 discussed above, the pivotal movement of the frame 346, and thus the coiler 324, may aid in allowing access to certain assemblies of the cushioning conversion machine 322, such as its severing assembly.

The illustrated frame 346 includes a base 350, a support panel 356 that forms part (specifically a lateral side) of a support border 357. The base 350 includes two side legs 358 that are pivotally coupled to the machine 322. This pivotal mounting is preferably accomplished via a tube 400 having its opposite ends supported by brackets 402. The brackets 402 are roughly "house-shaped" having their square shaped portion bolted to adjacent the upper edge and near the downstream edge of the machine 122 and their triangular portion projecting above the machine's top surface. The tube 400 extends between top projecting triangular portions whereby the tube 400 is positioned just above the machine's top surface. The distal end of each of the side legs 358 is rotatably secured to the tube 400 so that the base 350 may pivoted relative thereto. Preferably, the frame 346 includes a spring plunger 404 that is withdrawn to pivot the base 350 and a locking screw 406 to secure the base 350 in the operating position.

As was mentioned briefly above, the support panel 356 forms one lateral side or wall of the border 357. The border 357 additionally comprises another side wall 410 forming the other lateral side of the border 357, a top side wall 412 forming the top of the border 357, and a bottom side wall 414 forming the bottom of the border 357. In this manner, the border 357 comprises four side walls forming a boundary or frame which defines a large central rectangular opening. The top and bottom side walls 412 and 414 are positioned above and below the outlet-to-center zone Z, and the support panel 356 and the side wall 410 are positioned on the opposite lateral sides of the zone Z.

In the illustrated embodiment, the side legs 358 are spaced apart a distance corresponding to the lateral dimension of the border 357. The top edge of the support panel 356 is attached to one of the side legs 358 and the panel 356 extends downward and downstream therefrom. The illustrated panel 356 includes an upstream portion having the shape of a rectangular and a downstream portion having the shape of right-hand triangle with a rounded lower corner. The rounded lower corner matches the contour of the hub 65 of the rotating mechanism 348. The top edge of the side wall 412 is attached to the other side leg 358. The top wall 412 extends between the base's side legs 358 and the bottom wall 414 extends between the bottom edges of the support panel 356 and the side wall 410.

The side legs 358 preferably each include six openings 416 and the border 357 is attached to three aligned pairs of these openings via suitable fasteners. In this manner, the downstream distance of the support panel 356 and the border 357 (and the rotating mechanism 348 attached thereto) may be selectively adjusted by choosing the appropriate three openings 416. For example, for larger coils, the downstream-most three openings may be used, for smaller coils, the upstream-most three openings may be used. It may also be noted that the preferred construction of the support panel 356, the border 357, and the side legs 358 allows the coiler 324 to be assembled for either left hand removal of the coil C or right hand removal of the coil C, depending on which side leg 358 the support panel 356 is attached.

As was indicated above, the rotating mechanism 348 is rotatably mounted to the frame 346. More specifically, the mechanism's shaft 60 projects through a central opening in the bottom rounded corner of the support panel 356 and projects in a transverse direction into the outlet-to-center zone Z. The capture device 62 is non-rotatably attached to the projecting end of the shaft 60 whereby it is aligned with the outlet 34 of the cushioning conversion machine 322.

In the rotating mechanisms 48 and 248, the power source or motor was axially aligned with the shaft 60. In the cushioning conversion system 320, the motor 364 is instead axially offset from the shaft 60 and more particularly is mounted to the top upstream corner of the support panel 356. A drive chain 430 is provided to transfer rotational motion from the motor 365 to the shaft 60. (Preferably, the coiler 324 also includes a shield or cover 432 surrounding the drive chain 430.) This arrangement of the motor 365 allows it to be positioned at least partially above the outlet-to-center zone Z thereby making the coiler 324 more laterally compact. In comparison, the motor 26 of the coiler 24, for example, laterally increases the overall dimensions of the coiler 24. (See e.g., FIGS. 2 and 3.)

The guide device 326 guides the strip of cushioning product from the cushioning conversion machine's outlet to the coiler 324. The guide device 326 includes a first or bottom portion 374 and a second or top portion 376. The bottom portion 374 includes a lower wall 378 and no side walls. The top portion 376 includes an upper wall 382 and no side walls. In comparison, the portions 74 and 76 of the guide device 26 of the cushioning conversion system 20 each included two side walls forming a U-shaped channel. In the cushioning conversion system 120, the modified guide device portions 74 and 76 included only one side wall—the side wall of the coil-withdrawal side of the coiler 124 being eliminated to allow more convenient removal of the completed coil of cushioning product C. In the guide 326, the elimination of both of the side walls further facilitates the ability to assemble the coiler 324 for either left hand removal of the coil C or right hand removal of the coil C, depending on which side leg 358 the support panel 356 is attached.

In the illustrated embodiment, the lower wall 378 of the guide portion 374 has a generally straight geometry (in side view) except for a stepped section at its distal end. The upper wall 382 of the guide portion 376 includes an upstream straight section, an intermediate straight section and an upwardly curved distal section. When the guide device 326 is in its coil-begin position shown in FIG. 13, the lower wall 378 extends generally in the downstream direction. The upstream straight section of the upper wall 382 extends slightly downward in the downstream direction and the intermediate section extends slightly upward in the downstream direction. In this manner, there is clearance between curved distal section and the circular path of the capture members 66 of the capture device 62. During the initial coiling of the strip of cushioning product, this clearance provides sufficient space for the leading edge of the cushioning product (which may change size as it conforms to the capture members 66) to travel beneath the upper wall 382 whereby there is no obstruction to rotation.

The upstream ends of the guide portions 374 and 376 is attached to the coiler frame 346, and particularly the border 357, by pivoting hinges 439. The guide device 326 further comprises a lever assembly 440 which controls the pivoting action of the guide portions 374 and 376. Specifically, this lever assembly 440 is constructed and arranged so that as the bottom portion 374 is moved downward, the upper portion 376 is moved upward. The portions 374 and 376 are preferably biased to their coil-begin positions by, for example and as shown, an extension spring 442. The biasing force should be great enough to prevent "squirming" of the cushioning product during the coiling process but preferably not so great that it significantly affects the product's density characteristics. A stop pin 444 may be provided to prevent the upper portion 376 from moving below its coil-begin position.

As was indicated above, the controller 328 (which in the illustrated embodiment is mounted to the top of the border wall 412), controls the coiler 324 and preferably also the cushioning conversion machine 322. The strip-production indicator of the controller 328 preferably comprises a downstream strip sensor 396 that is mounted to the border 357 and that senses whether a strip is present at a downstream location. Preferably, the controller 328 controls the diameter of the coil by monitoring the length of the strip of cushioning product as it is being produced and by stopping the machine's production once the length corresponding to the desired diameter has been reached. The controller 328 preferably also controls the speed and/or torque setting of the motor 364 based on the characteristics of the cushioning product being produced, such as, for example, its density. Additionally or alternatively, the controller 328 preferably includes a switch that prevents operation of the coiler 324 if the frame 346 is in its upper (non-operating) position.

The coiler 324 may further comprise a seashell-shaped cover 460 having a side wall 462 situated adjacent an axial side of the coil of cushioning product C and an end wall 464 situated adjacent the downstream radial side of the coil C. The cover 460, and particularly the upstream edge of the side wall 462, is preferably attached to the downstream slanted edge of the support panel 256. The end wall 464 is preferably attached to the downstream radial edges of the side wall 462 (rather than formed in one piece therewith). This construction of the cover 460 further facilitates the ability to assemble the coiler 324 for either left hand removal or right hand removal of the coil C.

One may now appreciate that the features of the coiler 24/124/224/324, the guide device 26/326, and the controller 28/328 when used individually in the cushioning conversion system 20/120/320, or collectively as preferred, allow the convenient and consistent coiling of a strip of cushioning product into a coil of cushioning product which may be used for packaging purposes. Because the coiler 24/124/224/324 is adapted to allow the coil of cushioning product to be removed in its coiled configuration, it allows the coil itself to be used for blocking or bracing. The guide device 26/326 and the controller 28/328 also posses certain features which are advantageous when making a coil of cushioning product which remains in its coiled configuration when used as a packaging product. However, the guide device 26/326 and the controller 28/328 may also be advantageously incorporated into a system where a strip of cushioning product is coiled into a coil configuration, and then later uncoiled for use as a packaging product.

Although the invention has been shown and described with respect to certain preferred embodiments, it is obvious that equivalent alterations and modifications will occur to others skilled in the art upon the reading and understanding of this specification. The present invention includes all such equivalent alterations and modifications and is limited only by the scope of the following claims.

For the purposes of the United States, this application is a conversion of U.S. Provisional Application No. 60/063,275, filed on Oct. 27, 1997 and entitled "CUSHIONING CONVERSION SYSTEM AND METHOD FOR MAKING A COIL OF CUSHIONING PRODUCT" a conversion of U.S. Provisional Application No. 60/071,164, filed on Jan. 12, 1998 and entitled "CUSHIONING CONVERSION SYSTEM AND METHOD FOR MAKING A COIL OF CUSHIONING PRODUCT"; and a conversion of U.S. Provisional Application No. 60/095,702, filed on Aug. 7, 1998, and entitled "CUSHIONING CONVERSION SYSTEM AND METHOD FOR MAKING A COIL OF CUSH- IONING PRODUCT". The entire disclosures of these earlier applications are hereby incorporated by reference.

What is claimed is:

1. A cushioning conversion system for making a coil of cushioning product, said system comprising:

at least one cushioning conversion machine including a conversion assembly which converts a sheet stock material into strip of cushioning product and having an outlet through which the strip of cushioning product is emitted; and at least one coiler which rolls the strip of cushioning product into a coiled configuration to form a coil of cushioning product;

wherein the coiler is shaped and positioned to receive the strip of cushioning product as it is emitted from the outlet and to allow the coil of cushioning product to be removed from the coiler in its coiled configuration.

2. A cushioning conversion system as set forth in claim 1 further comprising a controller which controls the coiler based on the cushioning conversion machine.

3. A cushioning conversion system as set forth in claim 2 wherein the controller includes a strip-production indicator which indicates whether a strip of cushioning product is being produced by the cushioning conversion machine and wherein the controller controls the coiler, based on input from the strip-production indicator.

4. A cushioning conversion system as set forth in claim 3 wherein the controller activates the coiler upon the strip-production indicator indicating that a strip of cushioning product is being produced after a period of non-production.

5. A cushioning conversion system as set forth in claim 4 wherein the controller activates the coiler if the strip-production indicator indicates that a strip of cushioning product is being produced by the cushioning conversion machine.

6. A cushioning conversion system as set forth in claim 3 wherein the controller deactivates the coiler upon the strip-production indicator indicating that a strip of cushioning product is not being produced after a period of production.

7. A cushioning conversion system as set forth in claim 3 wherein the strip-production indicator is a strip sensing device which senses whether a strip of cushioning product is being emitted from the outlet of the cushioning conversion machine.

8. A cushioning conversion system as set forth in claim 7 wherein the strip sensing device comprises a downstream strip sensor which senses whether the strip is present at a downstream location.

9. A cushioning conversion system as set forth in claim 8 wherein the downstream location is adjacent the coilers center of rotation.

10. A cushioning conversion system as set forth in claim 8 wherein the coiler includes a capture device which captures the leading end of the strip of cushioning product and wherein the downstream location is positioned to insure that the leading end of the strip of cushioning product is captured by the capture device.

11. A cushioning conversion system as set forth in claim 8 wherein controller activates the coiler based on the downstream strip sensor sensing that the strip is present at the downstream location.

12. A cushioning conversion system as set forth in claim 11 wherein the controller activates the coiler based also on the upstream strip sensor sensing that the strip is present at the upstream location.

13. A cushioning conversion system as set forth in claim 8 wherein the controller deactivates the coiler based on the upstream sensor sensing that the strip is no longer present at the upstream location.

14. A cushioning conversion system as set forth in claim 13 wherein the controller deactivates the coiler after a set period of time following the upstream sensor sensing that the strip is no longer present at the upstream location, the set period of time corresponding to the period of time necessary to insure that the trailing end portion of the strip of cushioning product is coiled onto the coil of cushioning product.

15. A cushioning conversion system as set forth in claim 7 wherein the strip-sensing device includes an upstream strip sensor which senses whether the strip is present at an upstream location.

16. A cushioning conversion system as set forth in claim 15 wherein the downstream location is slightly downstream of the coiler's center of rotation.

17. A cushioning conversion system as set forth in claim 16 wherein the upstream location is upstream of the coiler's center of rotation.

18. A cushioning conversion system as set forth in claim 17 wherein the upstream location is adjacent the cushioning conversion machine's outlet.

19. A cushioning conversion system as set forth in claim 2 wherein the controller includes a ready-to-coil indicator which indicates whether the coiler is in a ready-to-coil condition to begin coiling a strip of cushioning product and wherein the controller controls the coiler based on input from the ready-to-coil indicator.

20. A cushioning conversion system as set forth in claim 19 wherein the controller activates the coiler based also on the ready-to-coil indicator indicating that coiler is in the ready-to-coil condition.

21. A cushioning conversion system as set forth in claim 2 wherein the controller automatically returns the coiler to a ready-to-coil condition.

22. A cushioning conversion system as set forth in claim 21 wherein the controller returns the coiler to the ready-to-coil condition when deactivating the coiler.

23. A cushioning conversion system set forth in claim 2 wherein the controller also controls the conversion assembly to produce a strip of cushioning product of predetermined length.

24. A cushioning conversion system as set forth in claim 2 wherein the controller also controls the conversion assembly to produce a coil of cushioning product of a predetermined diameter.

25. A cushioning conversion system as set forth in claim 2 wherein the controller includes a coil-diameter indicator which indicates the diameter of the coil of cushioning product.

26. A cushioning conversion system as set forth in claim 1 wherein the coiler includes a frame and a rotating mechanism rotatably mounted to the frame.

27. A cushioning conversion system as set forth in claim 26 wherein the frame includes a support panel on which the rotating mechanism is rotatably mounted.

28. A cushioning conversion system as set forth in claim 27 wherein the support panel extends from the outlet of the cushioning conversion machine past the center of rotation of the coiler.

29. A cushioning conversion system as set forth in claim 26 wherein the rotating mechanism includes a capture device which captures the leading end of the strip of cushioning product when the coiler is in a ready-to-coil condition.

30. A cushioning conversion system as set forth in claim 29 wherein the rotating mechanism includes a rotating shaft which rotates the capture device.

31. A cushioning conversion system as set forth in claim 30 wherein the rotating shaft is connected to, and directly rotates, the capture device.

32. A cushioning conversion system as set forth in claim 29 wherein the capture device includes a hub and at least two capture members which extend symmetrically from the hub.

33. A cushioning conversion system as set forth in claim 32 wherein outer surfaces of the capture members together define a tapering profile around which the strip of cushioning product is rolled to form the coil of cushioning product, the tapering being in a direction aligned with the direction of removal of the coil of cushioning product from the coiler.

34. A cushioning conversion system as set forth in claim 33 wherein the capture members each have cross-sectional areas which decrease in the tapering direction to define the tapering profile.

35. A cushioning conversion system as set forth in claim 32 wherein the capture members of the capture device are positioned for passage of a leading end of the strip of cushioning product therebetween when the coiler is in a ready-to-coil condition.

36. A cushioning conversion system as set forth in claim 35 wherein the capture members of the capture device are aligned in a plane perpendicular to a travel path of the strip of cushioning product as it is emitted from the cushioning conversion machine when the coiler is in the ready-to-coil condition.

37. A cushioning conversion system as set forth in claim 29 wherein the coiler further comprises a power source driving the rotating mechanism.

38. A cushioning conversion system as set forth in claim 37 wherein the power source is a motor.

39. A cushioning conversion system as set forth in claim 38 wherein the motor is axially aligned with the capture device.

40. A cushioning conversion system as set forth in claim 38 wherein the motor is axially misaligned with the capture device.

41. A cushioning conversion system as set forth in claim 38 wherein the motor is either a DC torque motor or a fluid powered motor.

42. A cushioning conversion system as set forth in claim 26 wherein the coiler further comprises a taping device which supplies tape for securing a trailing end of the strip of cushioning product in the coil of cushioning product.

43. A cushioning conversion system as set forth in claim 26 wherein the coiler further comprises an ejection mechanism which ejects the completed coil of cushioning product.

44. A cushioning conversion system as set forth in claim 43 wherein the taping device is positioned for manual dispensing of tape.

45. A cushioning conversion system as set forth in claim 26 wherein the frame is a self-standing structure.

46. A cushioning conversion system as set forth in claim 26 wherein the frame includes a wall shaped and positioned to be situated adjacent an axial side of the coil of cushioning product.

47. A cushioning conversion system as set forth in claim 46 wherein the cushioning conversion machine is self-standing.

48. A cushioning conversion system as set forth in claim 4 wherein the frame is mounted to the cushioning conversion machine.

49. A cushioning conversion system as set forth in claim 48 wherein the frame is pivotally mounted to the cushioning conversion machine whereby it may be moved to and from an operating position.

50. A cushioning conversion system as set forth in claim 49 wherein the frame comprises a base having two side legs pivotally coupled to opposite sides of the cushioning conversion machine.

51. A cushioning conversion system as set forth in claim 50 wherein the frame a pivot bar to which the base is pivotally mounted and wherein the pivot bar is fixedly mounted to opposite sides of the machine.

52. A cushioning conversion system as set forth in claim 1 wherein the conversion assembly includes a feed assembly which advances the stock material.

53. A cushioning conversion system as set forth in claim 52 wherein the feed assembly pulls the stock material.

54. A cushioning conversion system as set forth in claim 53 wherein the feed assembly includes rotating members.

55. A cushioning conversion system as set forth in claim 54 wherein the rotating members are gear members.

56. A cushioning conversion system as set forth in claim 55 wherein the gear members also coin a central band of the strip.

57. A cushioning conversion system as set forth in claim 54 wherein the feed assembly includes a power source for driving the rotating members.

58. A cushioning conversion system as set forth in claim 1 wherein the conversion assembly includes a forming assembly which forms the stock material.

59. A cushioning conversion system as set forth in claim 58 wherein the forming assembly inwardly turns the lateral edges of the sheet stock material.

60. A cushioning conversion system as set forth in claim 59 wherein the forming assembly forms lateral pillow portions and a central band therebetween.

61. A cushioning conversion system as set forth in claim 1 wherein the cushioning conversion machine further comprises a severing assembly, positioned downstream of the conversion assembly and upstream of the coiler, which cuts the strip of cushioning product after a specified length has been produced.

62. A cushioning conversion system as set forth in claim 61 wherein the cushioning conversion machine is horizontally oriented.

63. A cushioning conversion system as set forth in claim 62 further comprising a guide device which guides the strip of cushioning product from the cushioning conversion machine outlet to the coiler.

64. A cushioning conversion system as set forth in claim 1 further comprising at least one guide device which guides the strip of cushioning product from the cushioning conversion machine outlet to the coiler.

65. A cushioning conversion system as set forth in claim 64 wherein the guide device includes at least one portion which moves to accommodate the strip of cushioning product as the diameter of the coil of cushioning product increases.

66. A cushioning conversion system as set forth in claim 65 wherein the at least one portion moves between:

a coil-begin position whereat it accommodates the strip of cushioning product at the beginning of the formation of the coil of cushioning product; and a coil-complete position whereat it accommodates the strip of cushioning product at the completion of the formation of the coil of cushioning product.

67. A cushioning conversion system as set forth in claim 66 wherein the guide device includes a pivot hinge which is connected to the portion and which allows the portion to be pivoted in a first direction from a 0° angle to a non-zero angle and wherein:

the portion is pivoted 0° in the coil-begin position and extends between the cushioning conversion machine outlet and the coiler's center of rotation; and the portion is pivoted a non-zero angle in the first direction in the coil-complete position and extends in a path between the cushioning conversion machine's outlet and a circumferential portion of the completed coil of cushioning product.

68. A cushioning conversion system as set forth in claim 67 wherein the portion is pivoted at an acute angle in the first direction in the coil-complete position.

69. A cushioning conversion system as set forth in claim 67 wherein the portion is biased to the coil-begin position.

70. A cushioning conversion system as set forth in claim 69 wherein the portion is either spring biased or gravity biased to the coil-begin position.

71. A cushioning conversion system as set forth in claim 67 wherein the portion is also movable to a coil-release position whereat the coil of cushioning product may be released from the coiler.

72. A cushioning conversion system as set forth in claim 66 wherein the portion also moves among a plurality of positions between the coil-begin position and the coil-complete position.

73. A cushioning conversion system as set forth in claim 66 wherein the portion is also movable to a coil-release position whereat it is pivoted to a non-zero angle in the first direction, this angle being the same or greater in magnitude than the angle the portion is pivoted in the coil-complete position.

74. A cushioning conversion system as set forth in claim 65 wherein the portion includes a plurality of walls which define a U-shape channel.

75. A cushioning conversion system as set forth in claim 65 wherein the portion includes a plurality of walls which define an L-shaped channel.

76. A cushioning conversion system as set forth in claim 65 wherein the guide device comprises a first portion and a second portion.

77. A cushioning conversion system as set forth in claim 76 further comprising a lever assembly between the portions.

78. A cushioning conversion system as set forth in claim 1 wherein the cushioning conversion machine is not self-standing and wherein the system further comprises a stand for supporting the cushioning conversion machine.

79. A cushioning conversion system as set forth in claim 1 comprising two cushioning conversion machines and two coilers.

80. A cushioning conversion system as set forth in claim 79 wherein the cushioning conversion machines are symmetrically positioned relative to each other.

81. A cushioning conversion system as set forth in claim 79 wherein the coilers are symmetrically positioned relative to each other.

82. A cushioning conversion system as set forth in claim 1 wherein the rotating shaft is connected to a drive roller which indirectly rotates the capture device.

83. A cushioning conversion system as set forth in claim 82 wherein the drive roller is linearly movable relative to the capture device to accommodate the changing diameter of the coil of cushioning product.

84. A method of making a coil of cushioning product, said method comprising the steps of:

converting a sheet stock material into a strip of cushioning product;

winding the strip of cushioning product into a coiled configuration on a coiler; and removing the completely wound coil of cushioning product from the coiler in its coiled configuration.

85. A method of making a coil of cushioning product, said method comprising the steps of:

converting a sheet stock material into a strip of cushioning product in a cushioning conversion machine and emitting it through an outlet in the cushioning conversion machine;

winding the strip of cushioning product into a coiled configuration on a coiler to produce a coil of cushioning product;

controlling the coiler based on the production of the cushioning conversion machine; and removing the coil of cushioning product from the coiler in its coiled configuration.

* * * * *